United States Patent [19]

Takabayashi et al.

[11] Patent Number: 4,951,546

[45] Date of Patent: Aug. 28, 1990

[54] ELECTRONIC STRINGED MUSICAL INSTRUMENT

[75] Inventors: Youjiro Takabayashi; Takashi Norimatsu, both of Shizuoka, Japan

[73] Assignee: Yamaha Corporation, Hamamatsu, Japan

[21] Appl. No.: 296,807

[22] Filed: Jan. 13, 1989

[30] Foreign Application Priority Data

| | | | |
|---|---|---|---|
| Jan. 14, 1988 | [JP] | Japan | 63-7273 |
| Jan. 14, 1988 | [JP] | Japan | 63-7274 |
| Jan. 14, 1988 | [JP] | Japan | 63-7275 |
| Jan. 14, 1988 | [JP] | Japan | 63-7276 |
| Jan. 14, 1988 | [JP] | Japan | 63-7277 |
| Jan. 14, 1988 | [JP] | Japan | 63-7278 |
| Jan. 14, 1988 | [JP] | Japan | 63-7279 |

[51] Int. Cl.[5] ..... G10H 1/32; G10H 1/18; G10H 3/00

[52] U.S. Cl. ..... 84/718; 84/701; 84/702; 84/722; 84/723; 84/743

[58] Field of Search ..... 84/1.14–1.16, 84/DIG. 30, 1.01, 626, 627, 643–646, 701–703, 718–720, 722, 737, 738, 743, 744–745

[56] References Cited

U.S. PATENT DOCUMENTS

| | | | |
|---|---|---|---|
| 3,562,399 | 2/1971 | Yamauchi . | |
| 3,902,395 | 9/1975 | Avant | 84/1.16 |
| 4,292,875 | 10/1981 | Nourney . | |
| 4,321,852 | 3/1982 | Young, Jr. | 84/1.16 |
| 4,516,462 | 3/1985 | Schulze . | |
| 4,567,805 | 2/1986 | Clevinger . | |
| 4,630,520 | 12/1986 | Bonanno . | |
| 4,653,376 | 3/1987 | Allured et al. . | |
| 4,658,690 | 4/1987 | Aitken et al. | 84/1.14 |
| 4,669,482 | 6/1987 | Ophir . | |
| 4,676,134 | 6/1987 | Newell . | |
| 4,702,141 | 10/1987 | Bonanno . | |
| 4,723,468 | 2/1988 | Takabayashi et al. | 84/1.16 |
| 4,726,275 | 2/1988 | Aitken et al. | 84/1.15 |
| 4,730,530 | 3/1988 | Bonanno . | |
| 4,748,887 | 6/1988 | Marshall | 84/DIG. 30 |
| 4,794,838 | 1/1989 | Corrigan | 84/DIG. 30 |
| 4,817,484 | 4/1989 | Iba et al. | 84/DIG. 30 |
| 4,873,904 | 10/1989 | Norimatsu | 84/722 |

FOREIGN PATENT DOCUMENTS

| | | | |
|---|---|---|---|
| WO85-02705 | 6/1985 | European Pat. Off. . | |
| 0288062 | 10/1988 | European Pat. Off. | 84/1.16 |
| 3108865 | 2/1983 | Fed. Rep. of Germany . | |

*Primary Examiner*—A. T. Grimley
*Assistant Examiner*—Matthew S. Smith
*Attorney, Agent, or Firm*—Burns, Doane, Swecker & Mathis

[57] ABSTRACT

For elimination of an error made in a sound production, an electronic fretted and stringed musical instrument operates in a parameter adjusting mode of operation prior to a playing mode of operation, and the fret positions are adjusted for actual fret members in the parameter adjusting mode of operation for precisely deciding the fret position where a string is engaged, thereby allowing a sound with a note assigned to the decided fret position to be produced.

14 Claims, 23 Drawing Sheets

ELECTRONIC STRINGED MUSICAL INSTRUMENT

FIELD OF THE INVENTION

This invention relates to an electronic stringed musical instrument and, more particularly, to an electronic sound producing system including a musical instrument of the fretted and stringed type in addition to a signal controlled tone generator unit.

BACKGROUND OF THE INVENTION

A typical example of the electronic stringed musical instrument is disclosed in Japanese Patent Application laid-open ( Kokai ) No. 62-99790. In the electronic stringed musical instrument, super-sonic vibrations are periodically supplied from piezo electric transducers to strings, respectively, for deciding fret positions each assigned a fret member contacted with each of the strings, and each of the fret position is decided on the basis of a time interval measured from the production of a supersonic vibration to the receipt of an echo of the super-sonic vibration reflected from the fret member. When the fret positions are thus decided, the electronic stringed musical instrument is ready for the production of sounds. Upon detection of a plucking motion, the electronic musical instrument produces a sound with the particular note assigned to the fret position decided in the previous stage.

However, a problem is encountered in the electronic stringed musical instrument disclosed in the Japanese Patent Application laid-open in the credibility of the fret position decided on the basis of the time interval for which the super-sonic vibration travels. Namely, the prior-art electronic stringed musical instrument decides the fret position on the assumption that a distances between each piezo electric transducer and the respective fret members are unchangeable throughout the service life of the electronic stringed musical instrument. However, the distances tend to be varied within a relatively short time period due to a deformation of a neck portion where the fret members are embedded. Such a deformation takes place due to, for example, variations of the tension applied to each of the strings. Moreover, when each of the strings is lengthened, the time interval is also varied for every fret member. Another reason for an error made in the decision of the fret position is that the string is liable to transiently brought into contact with another fret member during a low frequency vibration produced by the plucking motion. If the string comes in contact with another fret member, the super-sonic vibration merely travels a shortened path in the string, and, accordingly, the time interval is fallen within a range established for another fret, thereby causing the electronic stringed musical instrument to make an error in the decision of the fret position. Noise vibrations further cause the electronic stringed musical instrument to make an error in the decision of the fret position, because the piezo electric transducer converts not only the echo of the super-sonic vibration reflected from the fret but also noise vibrations produced upon reflection from, for example, a tailpiece where the string is anchored into an electric signal.

The prior-art electronic stringed musical instrument further has a problem in the detection of the plucking motion. When the string is strongly plucked by the player, a low frequency vibration with a wide amplitude takes place in the string. The low frequency vibration is converted into an electric signal similar in waveform to the low frequency vibration, and the electronic stringed musical instrument detects the plucking motion when the amplitude of the electric signal excesses a predetermined threshold value. However, if the player repeats the plucking motion which results in a low frequency vibration with an extremely wide amplitude, the amplitude of the electric signal continues to remain over the predetermined threshold value, and, for this reason, the electronic stringed musical instrument looses the production timings for the latter plucking motions.

Still another problem is encountered in the prior art electronic stringed musical instrument in the variety of a musical playing technique. The electronic stringed musical instrument disclosed in the Japanese Patent Application laid-open does not take into account of various musical playing techniques such as, for example, a bent-string playing technique, a "legato" technique or a muting technique. Then, the musical expression is limited to a narrow range.

SUMMARY OF THE INVENTION

It is therefore an important object of the present invention to provide an electronic stringed musical instrument which is free from the error made in the decision of the fret position.

It is also an important object of the present invention to provide an electronic stringed musical instrument which discriminates every plucking motion even if each string is strongly plucked.

It is still another important object of the present invention to provide an electronic stringed musical instrument which is responsible to the various musical playing techniques.

To accomplish these objects, the present invention proposes to adjust the fret positions for the actual fret members, respectively, prior to entering the playing mode of operation.

In accordance with one aspect of the present invention, there is provided an electronic stringed musical instrument having a parameter adjusting mode and a playing mode of operation, comprising: (a) a plurality of fret members located at predetermined spacings and respectively assigned to fret positions which in turn are assigned notes, respectively; (b) a string stretched over the fret members and engageable any of the fret members; (c) vibration generating and receiving means for producing super-sonic vibrations in the string and receiving the super-sonic vibrations reflected from any of the fret members through the string, the super-sonic vibrations transmitted from the vibration generating and receiving means being reflected from a fret member engaged by the string; (d) fret position deciding means responsive to the super-sonic vibrations transmitted from and reflected to the vibration generating and receiving means for deciding the fret position assigned the fret member engaged by the string in the playing mode of operation; (e) sound production controlling means for producing a sound with the note assigned to the fret position decided by the fret position deciding means in the playing mode of operation; (f) fret position adjusting means operative to adjust the fret positions for the fret members, respectively, in the parameter adjusting mode of operation, the fret position adjusting means comprising (f-1) measuring means operative to measure propagation characteristic of the string, (f-2) calculating means operative to decide the fret positions of the fret members on the basis of the propagation characteristic, and (f-3) memory means operative to memorize the fret positions adjusted in the parameter adjusting mode of operation.

In accordance with another aspect of the present invention, there is provided an electronic stringed musical instrument having a parameter adjusting mode and a playing mode of operation, comprising: (a) a plurality of fret members located at predetermined spacings and respectively assigned to fret positions which in turn are assigned notes, respectively; (b) a string stretched over the fret members and engageable any of the fret members; (c) vibration generating and receiving means for producing super-sonic vibrations in the string and receiving the super-sonic vibrations reflected from any of the fret members through the string, the super-sonic vibrations transmitted from the vibration generating and receiving means being reflected from a fret member engaged by the string; (d) fret position deciding means responsive to the super-sonic vibrations transmitted from and reflected to the vibration generating and receiving means for deciding the fret position assigned the fret member engaged by the string in the playing mode of operation; (e) sound production controlling means for producing a sound with the note assigned to the fret position decided by the fret position deciding means in the playing mode of operation; (f) fret position adjusting means operative to adjust the fret positions for the fret members, respectively, in the parameter adjusting mode of operation, the fret position adjusting means comprising (f-1) measuring means operative to produce a time interval from a production of the super-sonic vibration to a receipt of the super-sonic vibration reflected from a standard fret member selected from the fret members, the fret position of the standard fret member being produced on the basis of the time interval, (f-2) calculating means operative to decide the fret positions of the fret members on the basis of the fret position measured for the standard fret member, and (f-3) memory means operative to memorize the fret positions adjusted in the parameter adjusting mode of operation.

BRIEF DESCRIPTION OF THE DRAWINGS

The features and advantages of an electronic stringed musical instrument according to the present invention will be more clearly understood from the following description taken in conjunction with the accompanying drawings in which.

DESCRIPTION OF THE PREFERRED EMBODIMENTS

Figure 1:
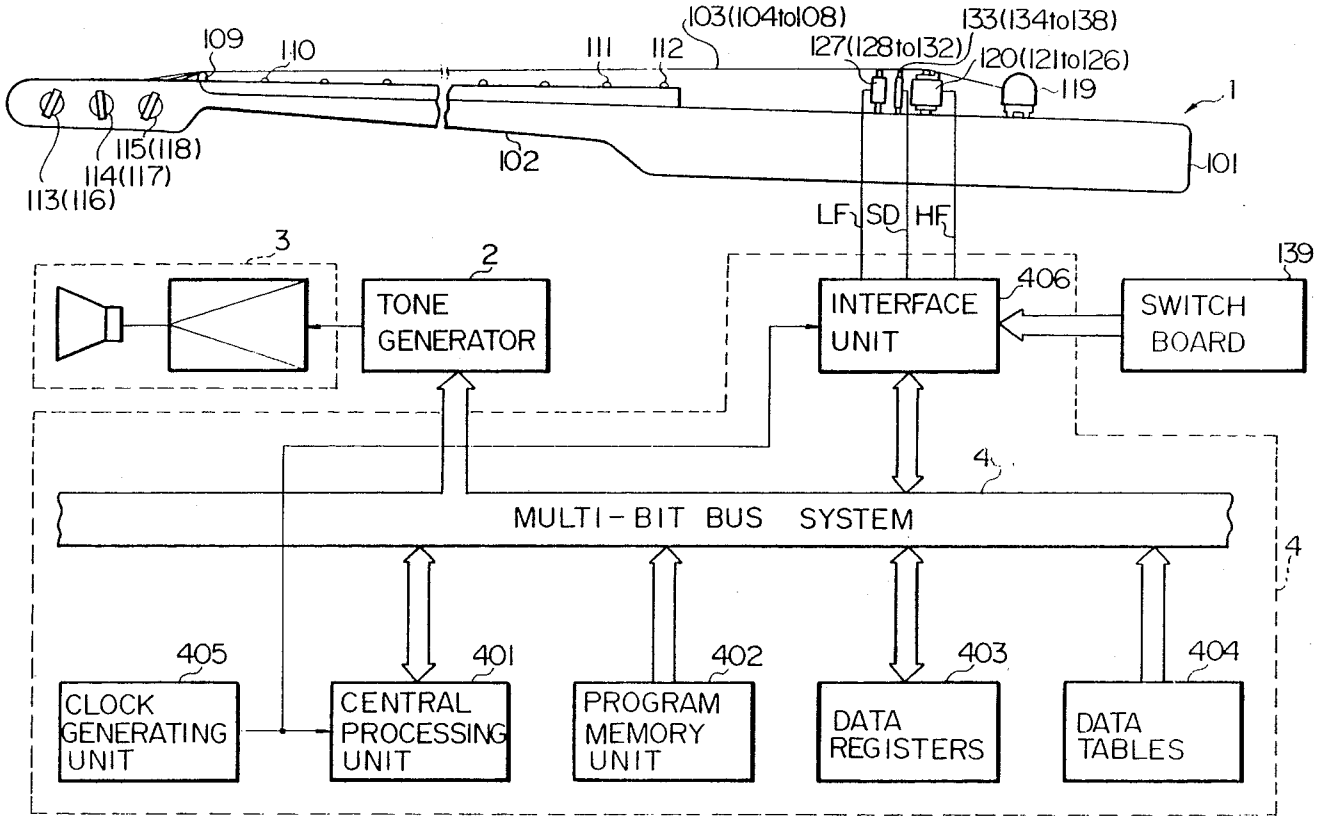
FIG. 1 is a side view showing the general arrangement of an electronic stringed musical instrument embodying the present invention;.

Referring first to FIG. 1 of the drawings, there is shown an electronic sound producing system embodying the present invention. The electronic sound producing system is of the fretted and stringed type provided with a guitar like musical instrument 1, a signal controlled tone generator unit 2, a sound unit 3 and a signal processing unit 4. Description is hereinunder made for the arrangement of the guitar like musical instrument, the arrangement of the signal processing unit 4, switches provided in the instrument, pieces of data information formed and used in the signal processing unit 4, tables providing various parameters and program sequences executed by the signal processing unit 4. However, the tone generator unit 2 and the sound unit 3 is well known in the art, and, for this reason, no further description is hereinunder incorporated.

General arrangement of guitar like musical instrument

The guitar like musical instrument 1 largely comprises a body portion 101, a neck portion 102, a plurality of or typically six strings 103 to 108, anchor members and a plurality of or typically twenty four fret members 109 to 112. The fret members 109 to 112 are provided on the front surface of the neck portion 102 in spacing relation ship from one another and assigned to respective notes except for the fret member 112. Each of the strings 103 to 108 is stretched over the fret members 109 to 112 and anchored at one end thereof to a peg 113, 114, 115, 116, 117 or 118 and at the other end thereof to a tailpiece 119. Each of the strings 103 to 108 thus stretched is brought into contact with at least one of the fret members 110 to 112 except for the fret member 109 in a pressing state where the string is pressed against the neck portion 102 by the player, however all of the strings 103 to 108 come into contact with the fret member 109 in the non-pressing state.

On the front surface of the body portion 101 are supported a plurality of piezo electric transducers 120 to 126 which are provided in association with the strings 103 to 108, respectively, and arranged to come into contact with the respective strings 103 to 108 for transmitting and receiving super-sonic frequency ( or ultra-audible ) vibrations. Namely, each of the piezo electric transducers 120 to 126 produces the super-sonic frequency vibration which is transmitted to each of the strings. Each string forwardly propagates the super-sonic frequency vibration, and the super-sonic frequency vibration is reflected from one of the fret members 109 to 112, then the string backwardly propagates an echo of the super-sonic frequency vibration which is converted into a high frequency electric signal HF by the piezo electric transducer. The piezo electric transducers 120 to 126 are electrically coupled to the signal processing unit 4, however, the arrangement and behaviors thereof are hereinafter described with reference to FIG. 2.

On the front surface of the body portion are further supported a plurality of pickup elements 127 to 132 which are also provided in association with the strings 103 to 108, respectively, for producing respective low frequency electric signals LF each having a waveform similar to a low frequency vibration produced upon a plucking motion. The pickup elements 127 to 132 are implemented by, for example, electromagnetic transducers, however, detailed description is omitted because a person in the art is well known.

Between the piezo electric transducers 120 to 126 and the pickup elements 127 to 132 are further provided a plurality of bend sensors 133 to 138 in association with the strings 103 to 108 for detecting string deviations from the neutral portions of the strings 103 to 108. When a music is performed with the guitar like musical instrument, the player sometimes slides one of the strings along the fret member where the string is pressed for slightly increasing the pitch of the sound. This sliding motion is called a "bent-string" playing technique, and each of the bend sensors 133 to 138 is provided for the detection of the sliding motion and produces a voltage signal SD representative of the string deviation from the neutral position. The guitar like musical instrument further comprises a switch board 139 provided with a plurality of switch units, and every switch unit is periodically scanned by the signal processing unit 4 for detecting whether or not any switch unit is actuated by the player.

Arrangement of the signal processing unit

The signal processing unit 4 comprises a central processing unit 401, a program memory unit 402 for storing programmed instruction codes executed by the central processing unit 401, a data registers 403 which is implemented by a random access memory device in this example, various data tables 404 implemented by, for example, read only memory device for fixedly storing parameters, a clock generating unit 405 producing an interrupt clock signal CL and an interface unit 406 coupled to the piezo electric transducers 120 to 126, the pickup elements 127 to 132, the bend sensors 133 to 138 and the switch board 139. The interrupt clock signal CL is produced at about 1 KHz in this example and supplied to both of the central processing unit 401 and the interface unit 406. With the interrupt clock signal CL, the central processing unit 401 branches to a timer interruption subroutine program which is described hereinafter under the subtitle of "timer interruption program sequence". When the interrupt clock signal CL is supplied to the interface unit 406, the interface unit 406 shares the time for providing a time frame and the peak value is decided for the low frequency electric signal LF in every time frame. The decision of the peak value is described hereinafter in detail.

In the signal processing unit 4 is further provided a multibit bus system 407 which interconnects the central processing unit 401, the program memory unit 402, the data registers 403, the various tables 404, the interface unit 406 and the tone generator unit 2 for a mutual communication therebetween. When a data code signal is supplied from the central processing unit 401 through the multi-bit bus system 407 to the tone generator unit 2, the tone generator unit 2 tailors a tone signal and transfers the tone signal to the sound unit 3, thereby allowing the sound unit 3 to produce a sound. Though not shown in the drawings, a peripheral device such as, for example, decoder circuits are provided in the signal processing unit 4 and a plurality of control signal lines are arranged for formation of a controlling network.

Arrangement of the interface unit

Figure 2:
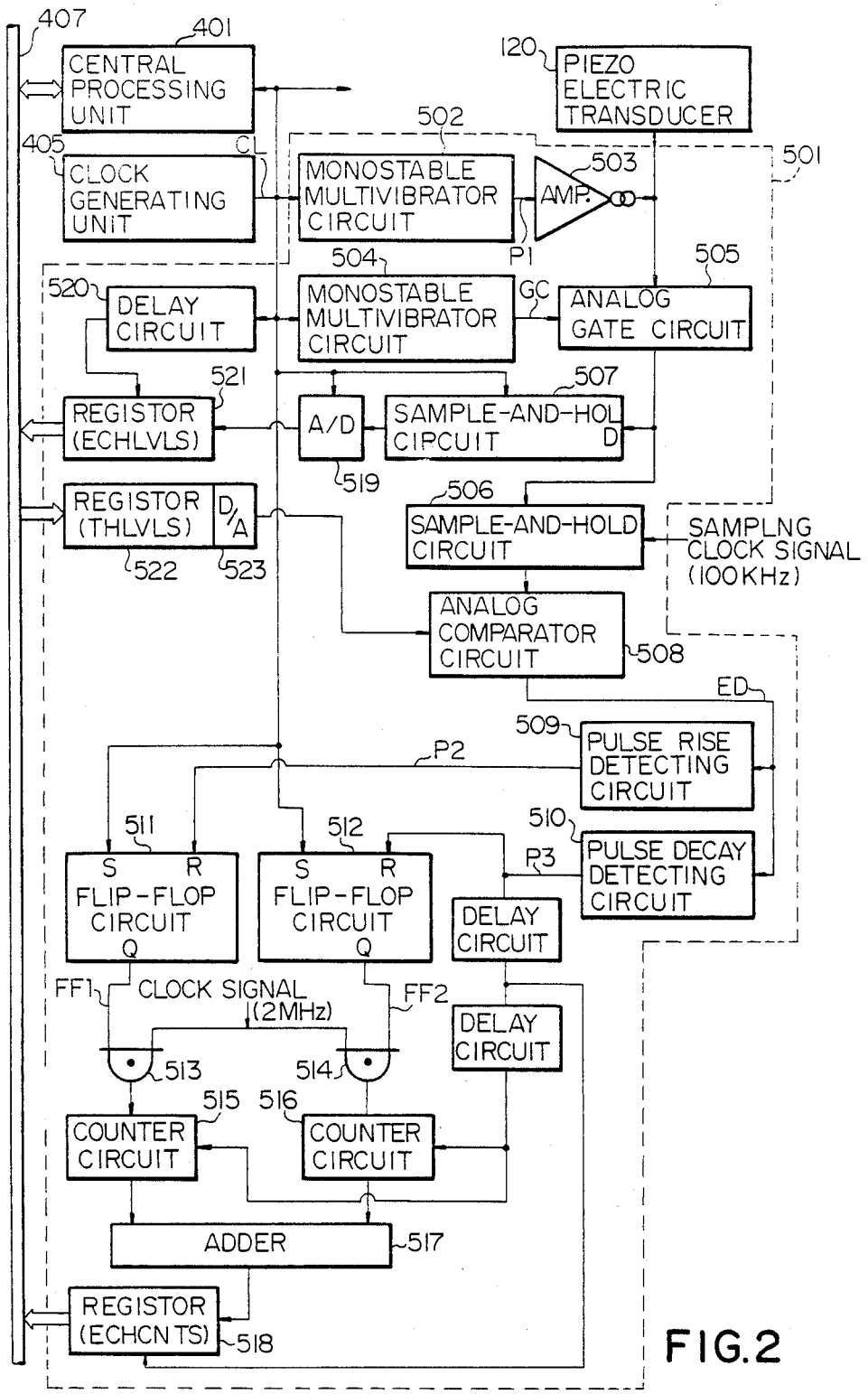
FIG. 2 is a block diagram showing the circuit arrangement of a part of the interface unit incorporated in the electronic stringed musical instrument shown in FIG. 1.

Turning to FIG. 2 of the drawings, the circuit arrangement of a part of the interface unit 406 is illustrated in detail together with the central processing unit 401, the clock generating unit 405, the multi-bit bus system 407 and the piezo electric transducer 120. The circuit illustrated in FIG. 2 serves as a time interval calculating circuit 501 which measures a time interval from a transmitting of the super-sonic frequency vibration to a receipt of an echo of the super-sonic frequency vibration. Although each of the piezo electric transducers 120 to 126 is accompanied with the time interval calculating circuit 501, only one time interval calculating circuit 501 is illustrated in FIG. 2. For the sake of better understanding, the description is made with reference to FIG. 3 which shows waveforms of essential signals.

Figure 3:
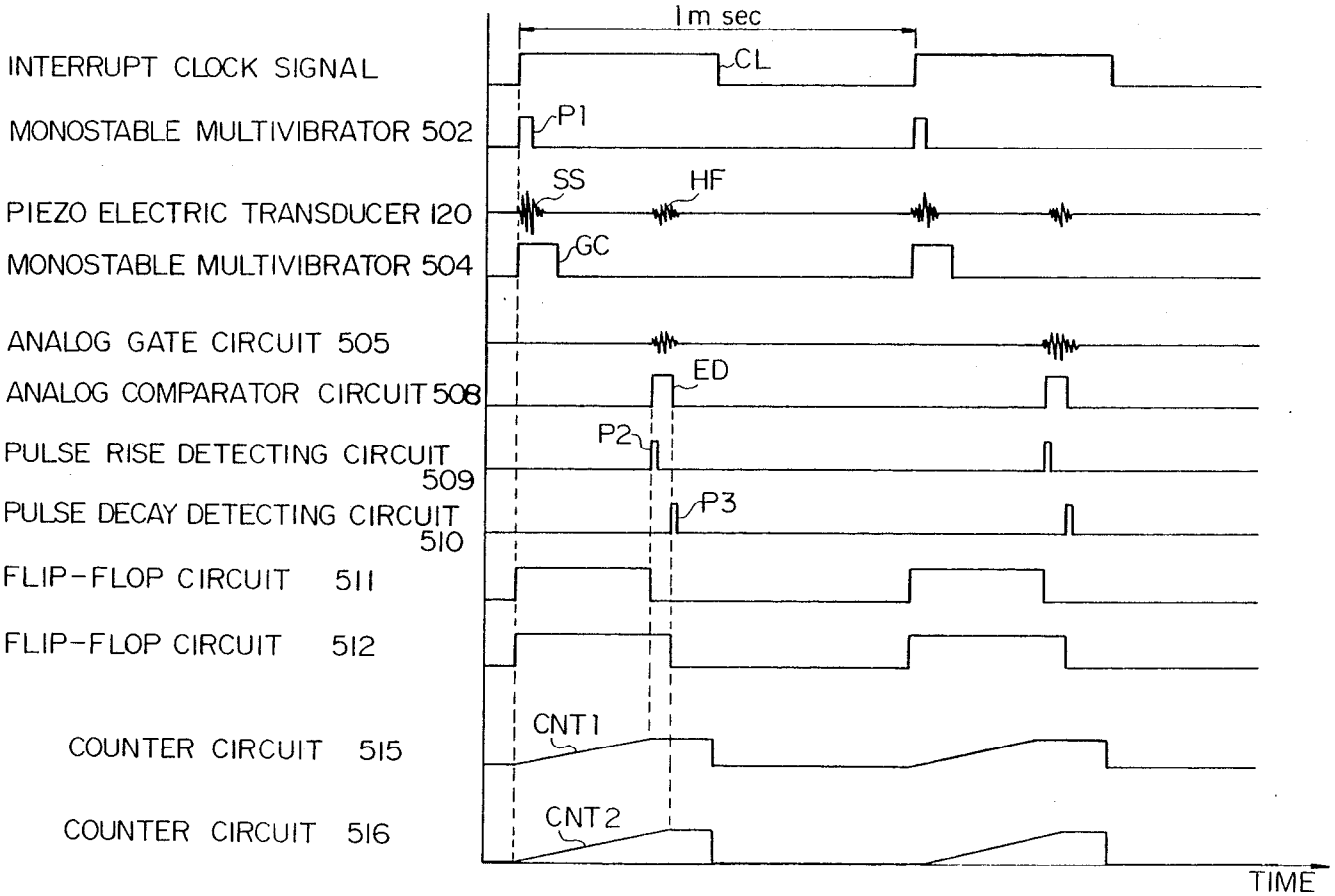
FIG. 3 is a diagram showing the waveforms of essential signals appearing in the circuit shown in FIG. 2.

As illustrated in FIG. 2, the interrupt clock signal CL is supplied from the clock generating circuit 405 to a monostable multivibrator circuit 502 as shown in FIG. 3, then the monostable multivibrator circuit 502 is triggered by the leading edge of the interrupt clock signal CL to produce a driving pulse signal P1. The driving pulse signal P1 is amplified by a combined amplifying and constant current keeping circuit 503, and, accordingly, an amplified driving signal is supplied to the piezo electric transducer 120. Since the interrupt clock signal CL is concurrently supplied to a monostable multivibrator circuit 504, the monostable multivibrator circuit 504 produces a gate control signal GC of an active high voltage level which is supplied to an analog gate circuit 505. The gate control signal GC is larger in the pulse width than the driving pulse signal P1. With the gate control signal GC of the active high voltage level, the analog gate circuit 505 remains in the off-state, and, for this reason, the amplified driving signal is blocked by the analog gate circuit 505.

With the amplified driving signal, the piezo electric transducer 120 produces a super-sonic frequency vibration SS which is transmitted to the string 103. The string 103 propagates the super-sonic frequency vibration SS in the forward direction, i.e., from the piezo electric transducer 120 to the fret member 109. If the player presses no string against any fret member, the super-sonic frequency vibration SS is reflected from the fret member 109 to the piezo electric transducer 120. When the echo EC of the super-sonic frequency vibration SS is thus produced at the fret member 109, the string 103 propagates the echo EC, which is also of the super-sonic frequency vibration, toward the piezo electric transducer 120. Upon receipt of the echo EC of the super-sonic frequency vibration, the piezo electric transducer 120 converts the echo EC into the high frequency electric signal HF which is supplied to the analog gate circuit 505. Before the high frequency electric signal HF reaches the analog gate circuit 505, the gate control signal GC is recovered to an inactive low voltage level, and, accordingly, the high frequency electric signal HF passes through the analog gate circuit 505. Then, the high frequency electric signal HF is supplied in parallel to sample-and-hold circuits 506 and 507. The sample-and-hold circuit 506 is responsive to a sampling clock signal of about 100 KHz and successively provides a series of discrete voltage values of the high frequency electric signal HF to an analog comparator circuit 508. A register 522 accompanied with a digital-to-analog converting circuit 523 stores a coded data bit string representing a threshold data information, and the threshold data information indicates a threshold value for discrimination between noise components and the echo reflected from the fret member. The analog comparator circuit 508 is operative to compare each of the discrete voltage values with a threshold value for elimination of the noise components produced on the basis of echoes of the super-sonic frequency vibration reflected from, for example, the tailpiece 119. However, when the high frequency electric signal HF is supplied to the analog comparator circuit 508, the series of the discrete voltage values excesses the threshold value, and, then, the analog comparator circuit 508 shifts the output voltage signal ED thereof from the low voltage level to the high voltage level. The output voltage signal ED is supplied in parallel to a pulse rise detecting circuit 509 and a pulse decay detecting circuit 510. This results in that the pulse rise detecting circuit 509 detects the leading edge of the output voltage signal ED to produce a first trigger pulse P2, however, the pulse decay detecting circuit 510 remains inactive.

When the interrupt clock signal CL is supplied to the monostable multivibrator circuits 502 and 504, the interrupt clock signal CL is further supplied to flip-flop circuits 511 and 512 so as to set the flip-flop circuits 511 and 512, then the flip-flop circuits 511 and 512 shift the output voltage signals FF1 and FF2 from the low voltage levels to the high voltage levels, respectively. With the output voltage signals FF1 and FF2 of the high voltage levels, AND gates 513 and 514 are transparent for a clock signal of about 2 MHz. Then, counter circuits 515 and 516 simultaneously start the respective counting operations, and for this reason, the respective counting values thereof are incremented as indicated by plots CNT1 and CNT2 in FIG. 3.

However, when the first trigger pulse P2 is supplied from the pulse rise detecting circuit 509 to the flip-flop circuit 511, the flip-flop circuit 511 is shifted to the resting state, then no output voltage signal FF1 is supplied from the flip-flop circuit 511 to the AND gate 513. This results in that the AND gate 513 is not transparent for the clock signal of about 2MHz. Then, the counter circuit 515 terminates the counting operation, and, for this reason, the number of the clock pulses remains in the counter circuit 515. Since the counting operation starts with the interrupt clock signal Cl and terminates upon the pulse rise detection, the number of the clock pulses or the counting value represents a time interval between the transmitting of the super-sonic frequency vibration SS and the arrival of the echo reflected from the fret member. On the other hand, the pulse decay detecting circuit 510 detects the trailing edge of the output voltage signal ED and, accordingly, produces a second trigger signal. With the second trigger signal, the flip-flop circuit 512 is shifted to the resting state, thereby terminating the output voltage signal FF2 thereof. When the flip-flop circuit 512 shifts the output voltage signal FF2 to the inactive low voltage level, the AND gate 514 blocks the clock signal of about 2 MHz, and the counter circuit 516 terminates the counting operation. Upon termination of the counting operation, the counter circuit 516 holds the counting value equal to the number of the clock pulses from the transmitting of the super-sonic frequency vibration SS to the decay of the echo reflected from the fret member. Then, the counting value represents the time interval between the transmitting of the super-sonic frequency vibration and the decay of the echo.

Since both of the counter circuits 515 and 516 are coupled to an adder 517, the adder 517 calculates the total sum of the counting values representing the two time intervals, and, then, the total sum is memorized in a register 518 as a time interval data information ECHCNTS. The reason why the adder is provided for calculation of the total sum of the two time intervals is that the time interval data information is not affected by the fret position where the echo is produced. Namely, if the player presses the string against the neck portion 102 between the fret members 109 and 110, the echo of the super-sonic frequency vibration is relatively small in amplitude. However, when the string is brought into contact with the fret member 112, the fret member 112 produces the echo having a relatively larger amplitude. Moreover, the echo is not stable in the waveform at all times. In this situation, if the time interval data information is produced on the basis of the single time interval, the time interval data information would not precisely represent the correct fret position. However, when the time interval data information is produced on the basis of the total sum of the two time intervals, the influences are eliminated from the time interval data information.

As shown in FIG. 2 of the drawings, the interrupt clock signal CL is further supplied to the sample-and-hold circuit 507. Since the high frequency electric signal HF is supplied to the sample-and-hold circuit 507 as well as the sample-and-hold circuit 506 for the echo detection, the sample-and-hold circuit 507 keeps the peak value of the high frequency electric signal HF. The sample-and-hold circuit 507 is responsive to the interrupt clock signal CL, and the peak value of the high frequency electric signal HF is transferred from the sample-and-hold circuit 507 to an analog-to-digital converting circuit 519. Then, the peak value is converted into the digital form. A delay circuit 520 retards the interrupt clock signal CL to produce a latching signal which is supplied to a register 521. With the latching signal from the delay circuit 520, the peak value in the digital form is memorized in the register 521 as an echo amplitude data information ECHLVLS.

Figure 4:
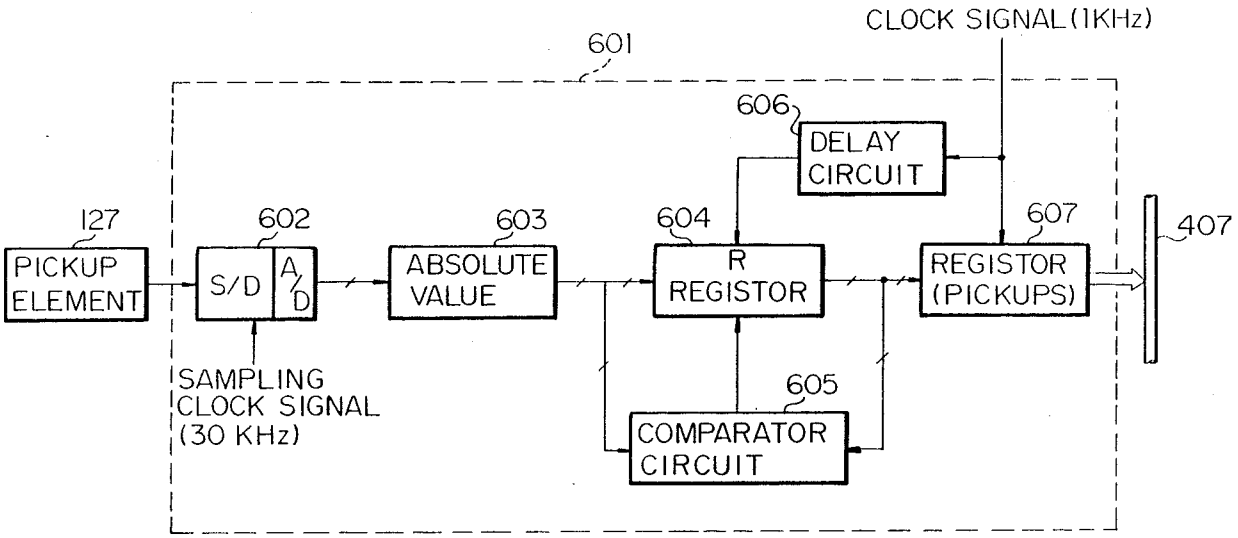
FIG. 4 is a block diagram showing the circuit arrangement of another part of the interface unit incorporated in the electronic stringed musical instrument shown in FIG. 1.

Turning to FIG. 4 of the drawings, there is shown another part of the interface unit 406 illustrated in FIG. 1. The circuitry illustrated in FIG. 4 serves as a peak value detecting circuit 601 for deciding a series of the peak values of the low frequency electric signal LF. The peak value detecting circuit 601 is provided for each of the pickup elements 127 to 132, however, FIG. 4 merely shows one of them associated with the pick up element 127. The pickup element 127 is coupled to a combined circuit 602 of a sample-and-hold circuit (, which is abbreviated as "S/D" in FIG. 4 ) and an analog-to-digital converting circuit 602 ( which is abbreviated as "A/D"), and the sample-and-hold circuit section is responsive to a sampling clock signal of about 30 KHz for producing discrete voltage values. The discrete voltage values are supplied to the analog-to-digital converter section to form the digital data bit string equivalent to each of the discrete voltage value. The sign bit is eliminated from the digital data bit string by an absolute value producing circuit 603 to form the digital data bit string representing the absolute value of the discrete voltage value. The digital data bit string is then supplied from the absolute value producing circuit 603 to a register 604 and a comparator circuit 605 in a parallel manner. The clock signal of about 1 KHz is supplied in parallel to a delay circuit 606 and a register 607. The delay circuit 606 retards the clock signal of about 1 KHz and, then, transfers the delayed clock signal to the register 604 for shifting to the resting state. After shifting into the resting state, the digital data bit string is supplied to the register 604 for temporal storage and to the comparator circuit 605 for comparison with the digital data bit string stored in the register 604. When the first digital data bit string is supplied from the absolute value producing circuit 603, the comparator circuit 605 decides that the first digital data bit string is larger in value than the contents of the register 604, because the register 604 has been shifted to the resting state. Then, a latching signal is supplied from the comparator circuit 605 to the register 604, thereby allowing the first digital data bit string is memorized in the register 604. However, if the second digital data bit string is smaller in value than the first digital data bit string, no latching signal is supplied from the comparator circuit 605 to the register 604, and, for this reason, the second digital data bit string is not memorized into the register 604. Thus, the digital data bit string representing the absolute value of every discrete voltage value of the low frequency electric signal is compared with the previous digital data bit string for detecting the maximum value over a time interval of about 1 milisecond. Prior to the termination of the time interval of about 1 mili-second, the clock signal of about 1 KHz activates the register 607 for memorization of the digital data bit string which has the maximum value during the time interval of about 1 mili-second. After the memorization, the register 604 is shifted to the resting state with the delayed clock signal from the delay circuit 606. In this way, the digital data bit string with the maximum value is decided over the time interval of about 1 milisecond and memorized in the register 607 as a peak value data information PICKUPS.

Figure 5:
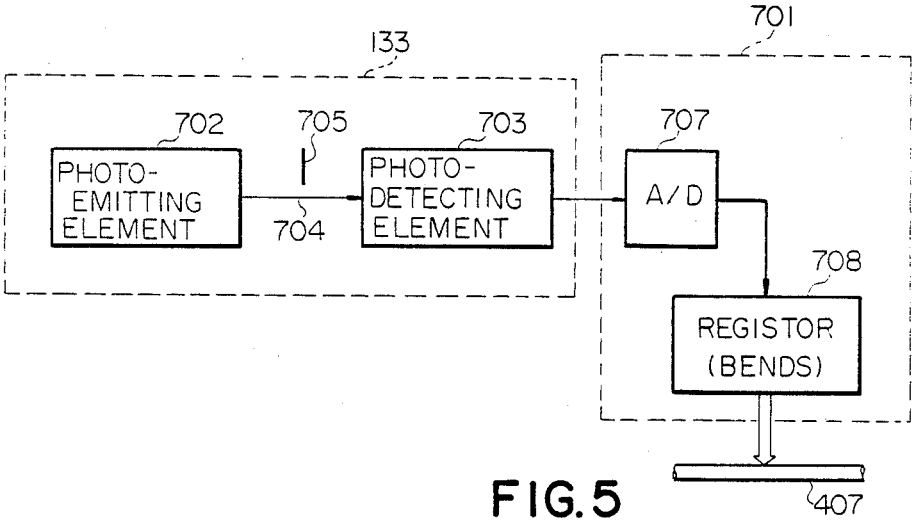
FIG. 5 is a block diagram showing the circuit arrangement of still another part of the interface unit incorporated in the electronic stringed musical instrument shown in FIG. 1.
Figures 6A, 6B, 6C:
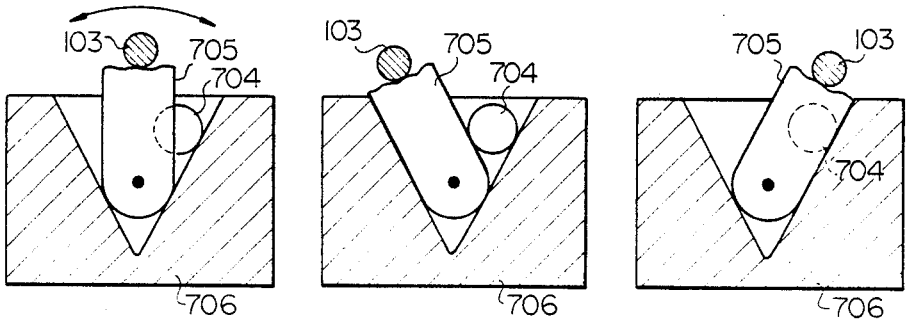
FIGS. 6A to 6C are front views each showing the shutter plate of the bend sensor installed in the electronic stringed musical instrument shown in FIG. 1.

Turning to FIG. 5 of the drawings, description is made for still another part of the interface unit 406. The circuitry illustrated in FIG. 5 serves as a string deviation detecting circuit 701. The string deviation detecting circuit 701 is provided for each of the bend sensors 133 to 138, however, only one string deviation detecting circuit is illustrated for the bend sensor 133 in FIG. 5. For this reason, description is focused upon the string deviation detecting circuit 701 provided in association with the bend sensor 133. The bend sensor 133 is provided with a photo-emitting element 702 such as, for example, a photo-emitting diode, a photo-detecting element 703 such as, for example, a photo-detecting diode provided on an optical path 704 from the photo-emitting element 702 and a shutter plate 705 capable of interrupting the optical path 704. As will be seen from FIGS. 6A to 6C, the shutter plate 705 is turnably supported by a blacket member 706 and comes into contact with the string 103. The shutter plate 705 thus arranged turns from the neutral position shown in FIG. 6A toward one of the deviate positions shown in FIGS. 6B and 6C depending upon the bent-string playing technique. When the shutter plate 705 is in the neutral position, the shutter plate 705 is overlapped with a half of the optical path 704. However, if the player slides the string 103 to one side of the neck portion 102, the optical path reaches the photo-detecting element 703 without any interruption as shown in FIG. 6B. On the other hand, if the string 103 is pushed to the other side of the neck portion, the optical path 704 is perfectly blocked by the shutter plate 705 as shown in FIG. 6C. The photodetecting element 703 produces the voltage signal SD the voltage level of which is roughly in proportional to the cross sectional area of the optical path 704. Then, voltage signal SD is varied in voltage level by changing the amount of string deviation and, accordingly, the amount of the turning angle of the shutter plate 705.

The string deviation detecting circuit 701 comprises an analog-to-digital converting circuit 707 and a register 708. The voltage signal SD is supplied from the photo-detecting element 703 to the analog-to-digital converting circuit 707, so that the voltage signal SD is converted to the digital data bit string representing the voltage level of the signal SD. In this example, the digital data bit string has a value ranging from $00_H$ to $7F_H$. The digital data bit string is transferred to the register 708 for memorizing therein as a bend data information BENDS.

Arrangement of the switch board

On the switch board 139, there are provided a main switch, a "legato" switch, a left-hand switch, an initialization switch, a set of tone color selecting switches, a volume switch, and a set of bend curve selecting switches. The central processing unit 401 periodically checks into the switch board to see whether or not any switch is operated. The main switch is operated for activation of the electronic stringed musical instrument or termination of the activated state. Namely, when the main switch is operated, the electronic stringed musical instrument is electrically coupled to a power source, and the central processing unit 401 executes a main-routine program illustrated in FIG. 9.

Figure 7:
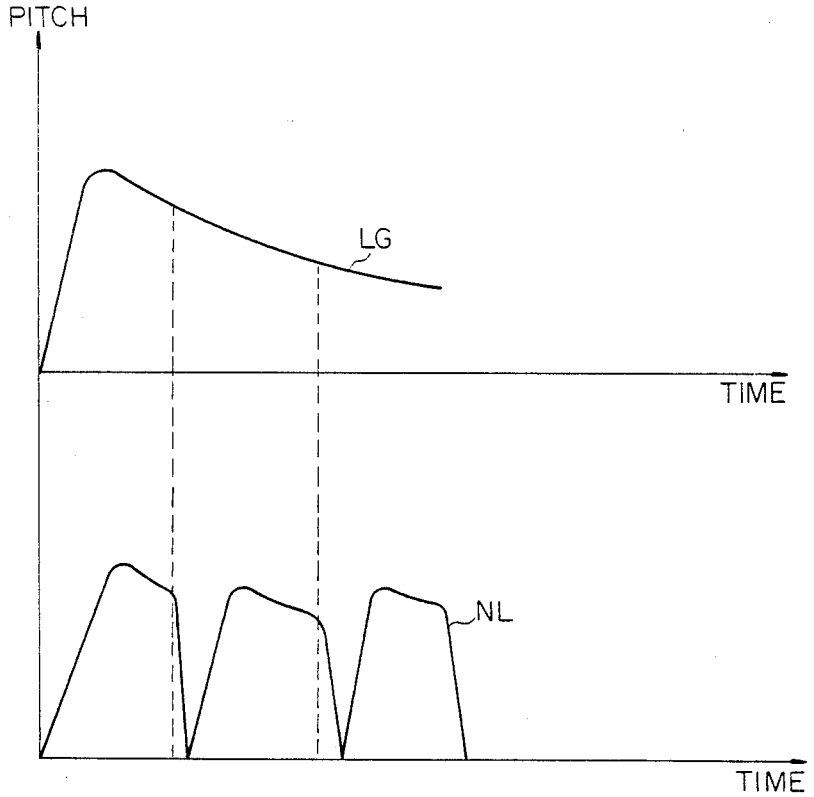
FIG. 7 is a diagram showing two envelops of sounds one of which is produced in the legato playing technique and the other of which is produced upon the ordinary plucking motions.

When the legato switch is operated, the legato is provided for a series of sounds different in note upon being performed. Namely, if three sounds with different notes are produced without the legato, the three discrete sounds takes place as indicated by plots NL in FIG. 7. However, when these notes are produced after the operation of the legato switch, the sound is smoothly varied in the pitch without any attack as indicated by plots LG even if the player changes the fret position.

The left-hand switch is used for producing sounds without any plucking motion. Namely, after an operation of the left-hand switch, the player is able to produce sounds by pressing the strings against the neck portion 102 only. Then, the player can continue the performance with the left hand only.

Figure 9:
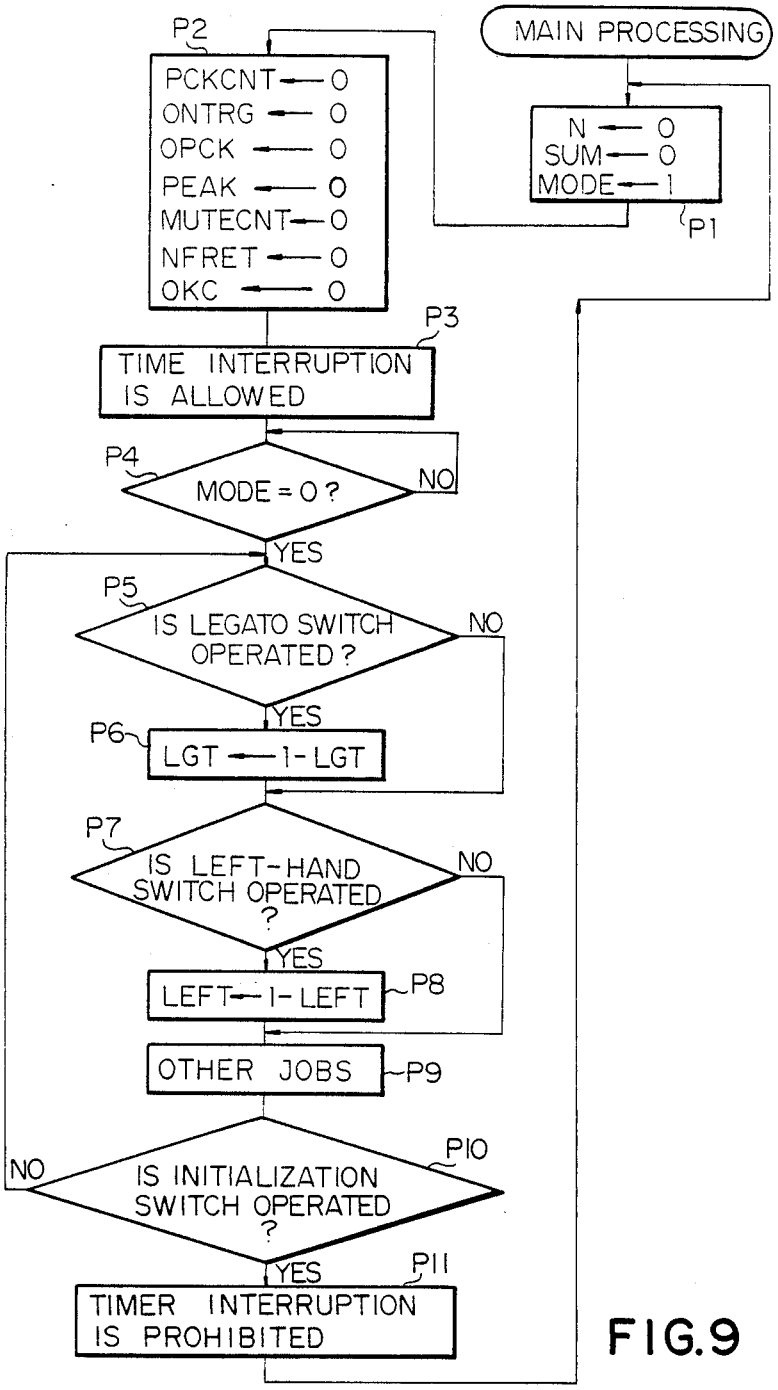
FIG. 9 is a flowchart showing the sequence of a main-routine program executed by a central processing unit incorporated in the electronic stringed musical instrument shown in FIG. 1.
Figure 10:
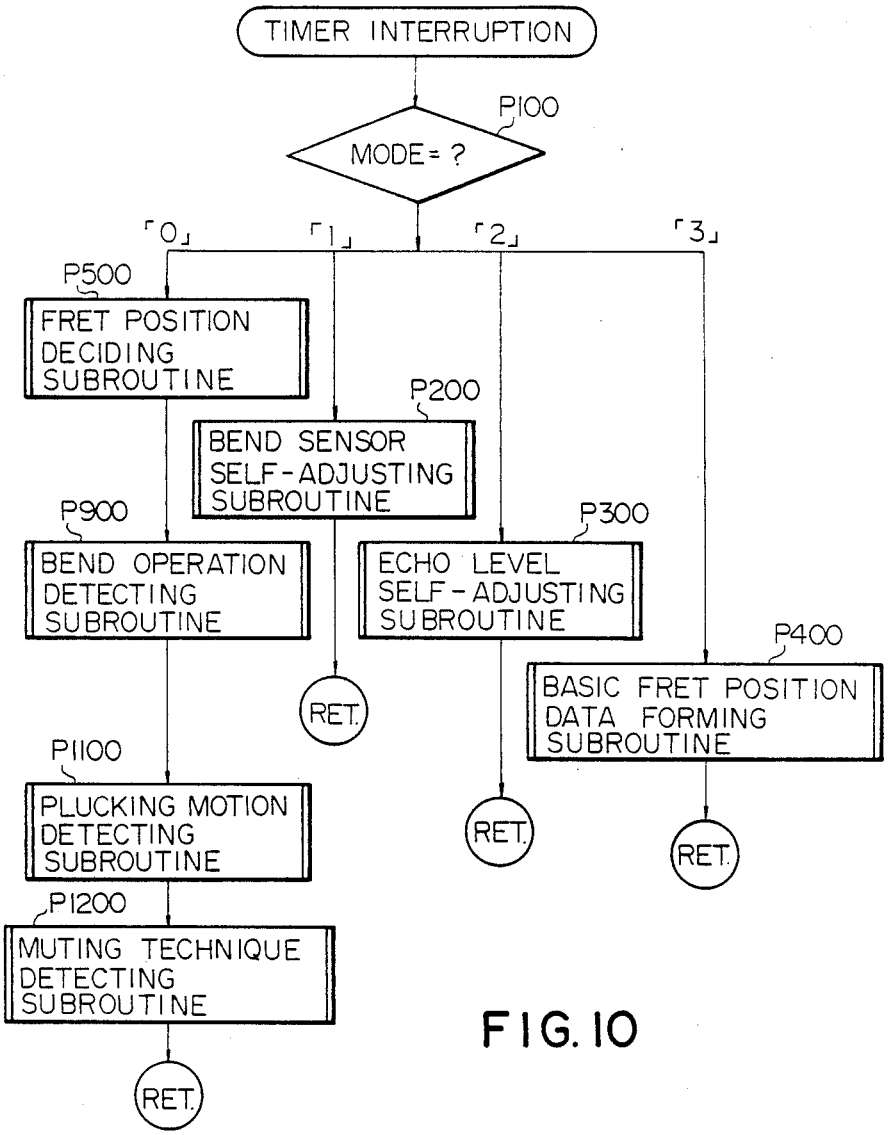
FIG. 10 is a flowchart showing a timer interruption program sequence executed by the central processing unit upon a timer interruption.

The initialization switch is used for a re-establishment of a data information which has been established during subroutine programs executed illustrated in FIGS. 9 and 10. The volume switch is operated for the variation of the magnitude of the sounds. The variation in the magnitude is carried out for every string and all of the strings. The tone color selecting switches are used for selection of the tone color applied to the sounds, and the tone color selecting switches respectively correspond to acoustic tone colors of, for example, guitar and violin and to synthetic tone colors.

Figure 8:
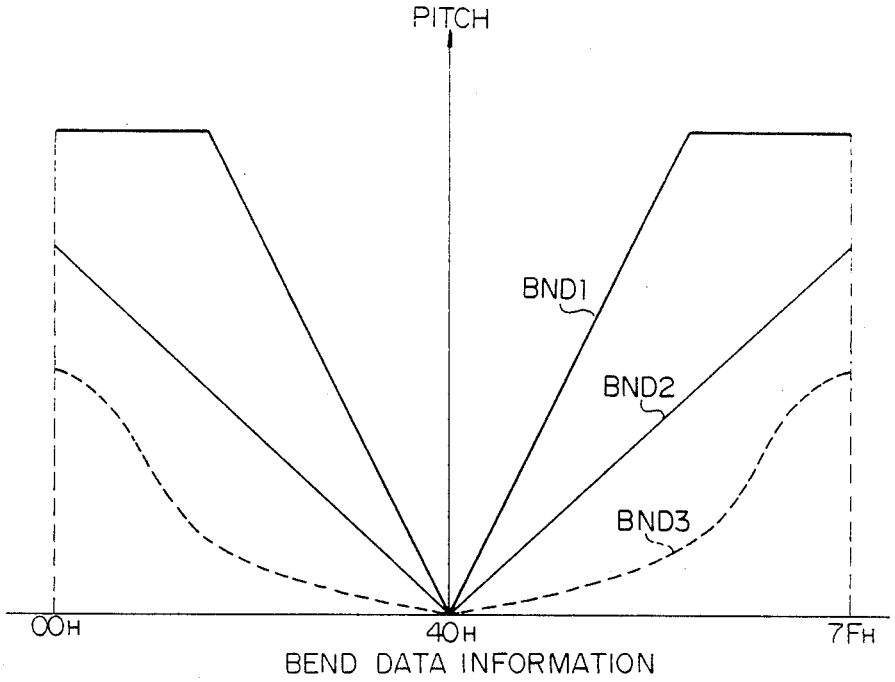
FIG. 8 is a graph showing various bend curves used for the variation in pitch upon the bent-string playing technique.

The bend curve selecting switches are used for selecting one of various plots BND1 to BND3 shown in FIG. 8. If one of the plots BND1 to BND3 such as, for example, the plots BND1 is selected, the pitch of the sound is linearly changed depending upon the value represented by the bend data information, however, the pitch is kept constant after passing a certain mid point. On the other hand, if the player selects the plots BND2 by using the bend curve selecting switches, the pitch of the sound is linearly changed over the whole range. However, if the plots BND3 is selected by the player, the pitch of the sound is gradually increased from the neutral position to a certain mid position and, then, is rapidly increased.

Pieces of data information stored in the registers 403

Pieces of data information described hereinbefore are stored in the data registers 403 in a rewritable manner and accessed by the central processing unit 401 during the execution of a program sequence which will be described hereinlater.

A bend sensor data information BEND corresponds to the bend data information BENDS and, for this reason, has a value ranging from $00_H$ to $7F_H$. The neutral value is $40_H$.

A pitch variation data information BENDC represents a increment of the pitch of a sound due to the bent-string playing technique.

A bend correcting data information BENDI represents the difference between the designed neutral position and the neutral position of the shutter plate 705 of the actual bend sensor installed in the electronic stringed musical instrument.

A fret boundary data information CNTTHi represents a boundary value for discriminating a fret position from the adjacent fret position.

An interval data information ECHCNT corresponds to the time interval data information ECHCNTS.

A zero fret position data information ECHCNTI represents a time interval memorized for the fret member 109 ( which is referred to as "zero fret member").

A peak level data information ECHLVL corresponds to the echo amplitude data information ECHLVLS.

A non-pressing state level data information ECHLVLI corresponds to the echo amplitude data information ECHLVLS decided for the fret member 109.

A fret position data information FRET indicates a fret position assigned the fret member which comes in contact with the string.

An index parameter indicates a fret position which is incremented for deciding the fret position assigned the fret member contacting the string.

A key code data information KC represents a key code assigned to the fret member contacting the string.

A sensor position data information LB represents a time interval corresponding to the distance between the bend sensor and the tailpiece 119.

A left-hand mode flag information LEFT is shifted between the logic "0" level and the logic "1" level depending upon the mode of operation, and the logic "1" level indicates the left-hand mode of operation, but the left-hand mode flag is lowered to indicate the logic "0" level in another mode of operation.

A bent-string position data information LF represents a distance between the tailpiece 119 and the fret member where the string comes into contact.

A legato mode flag information LGT is shifted between the logic "0" level and the logic "1" level depending upon the mode of operaiton, and the legato mode flag rises to the logic "1" level in the legato mode of operation, but is lowered in another mode of operation.

A magnification data information MPL is used for detection of the plucking motion. In this instance, the magnification data information MPL is selected to be 2.0 for a low level case and 1.5 for a high level case, then the plucking motion is detected when an amplitude of the low frequency electric signal LF is one point five or two times larger than the previous amplitude.

A mode data information MODE represents the mode of operaiton currently established. When the electronic stringed musical instrument is established in the playing mode of operation, the mode data information MODE is set to "0" value, however, the mode data information MODE of "1", "2" or "3" represents respective self-adjusting modes of operation.

A mute threshold data information MUTE represents a threshold value for detection of the muting technique.

A mute count data information MUTECNT is used for deciding whether or not muting technique is performed. Namely, when the mute count data information MUTECNT is decreased in value to "0", the central processing unit 401 decides whether or not the muting technique is performed depending upon the peak level data information ECHLVL.

A repetition data information N indicates the number of repetitions executed for deciding an average. The repetition data information is further used for indication of a fret position temporary assumed A temporal fret position data information NFRET represents a fret position assumed through a single fret position deciding operation. In this instance, if the temporal fret position data information NFRET is identical in value three times, the temporal fret position data information NFRET is confirmed as the fret position data information FRET.

A producible key code data information OKC is set to "0" while the electric stringed musical instrument should be silent, otherwise the producible key code data information OKC has a value representing a key code representing the note of the sound currently produced.

A previous peak value data information OPCK indicates the peak value data information PICKUPS decided in the previous time interval.

A key-on trigger flag information ONTRG indicates whether or not a plucking motion is detected, and the key-on flag rises to "1" value when the peak value data information excesses the threshold value.

A maximum peak value data information PEAK represents the largest peak value detected after the key-on trigger flag rises.

A time control data information PCKCNT is initially set to ten in this instance and decremented with time after the decay of the low frequency electric signal LF. When the time control data information reaches the predetermined value of, for example, seven, the electronic stringed musical instrument is ready for production of a sound. After this, the time control data information PCKCNT is decreased in value one-by-one in every time interval of about 1 mili-second.

A pickup boundary data information PCKLS represents a boundary for selection of the magnitude data information MLP.

A pickup threshold data information PCKTH represents the threshold value for detecting the plucking motion.

An virtual deviate amount data information X represents an virtual amount of the deviation which will be described in detail with reference to FIG. 18.

The threshold data information THLVLS is stored in the register 522 and is equal in value to the echo discriminating threshold data information THLVL.

Contents of the tables 404

The data tables 404 includes the following tables.

A table BENDCNV is used for converting the voltage signal SD representative of the string deviation into a pitch variation. The bend sensor data information is supplied to the table BENDCNV, then the pitch variation data bit string represented by BENDC(BEND) is delivered from the table BENDCNV to the data registers 403 for memorizing as the pitch variation data information BENDC. The table BENDCNV is used in a pitch variation calculating subroutine program illustrated in FIG. 18.

A table FKCNV stores six sets of key codes FKCNV, and each set is provided for each of the strings 103 to 108. Each key code in each set is assigned to each of the fret positions. The table FKCNV is responsive to the fret position data information FRET and provides the key code represented as FKCNV(FRET). The table FKCNV is used in a mute detecting subroutine program illustrated in FIG. 21. Table 1 shows the correspondence between the fret position and the key code, and the fret positions 0, 1, . . . 23 and 24 are assigned to the fret members 109, 110, . . . , 111 and 112. Table 2 shows the correspondence between the key code and the note assigned thereto. (blank)

TABLE 1

| String No. | fret position 0, | 1, | 2, . . . ,23, | 24 |
|---|---|---|---|---|
| 1 | 64 | 65 | 66 . . . 87 | none |
| 2 | 59 | 60 | 61 . . . 82 | none |
| 3 | 55 | 56 | 57 . . . 78 | none |
| 4 | 50 | 51 | 52 . . . 73 | none |
| 5 | 45 | 46 | 47 . . . 68 | none |
| 6 | 40 | 41 | 42 . . . 63 | none |

TABLE 2

| | | |
|---|---|---|
| note: | C1 . . . E1 . . . A1 . . . C2 C2# | D2 . . . G2 . . . B2 C3 . . . E3 . . . C4 . . . C5 . . . C6 |
| key code: | 36 . . . 40 . . . 45 . . . 48 49 | 50 . . . 55 . . . 59 60 . . . 64 . . . 72 . . . 84 . . . 96 |

A stored peak value data information PICKUP corresponds to the peak value data information PICKUPS transferred from the register 607.

A accumulation data information SUM represents the total sum calculated for deciding the average.

A touch data information TOUCH represents a string touch assumed from the maximum peak value data information PEAK and used for controlling the volume of the sound produced.

An echo discriminating threshold data information THLVL represents a threshold value used for discriminating the echo reflected from the fret member from the noises.

A repetition number count data information SMCNT represents the number of the fret position deciding operations repeated for confirmation of the actual fret position. When the repetition number count data information SMCNT reaches value of, for example, three, the fret position is finally confirmed in this instance.

Figure 17:
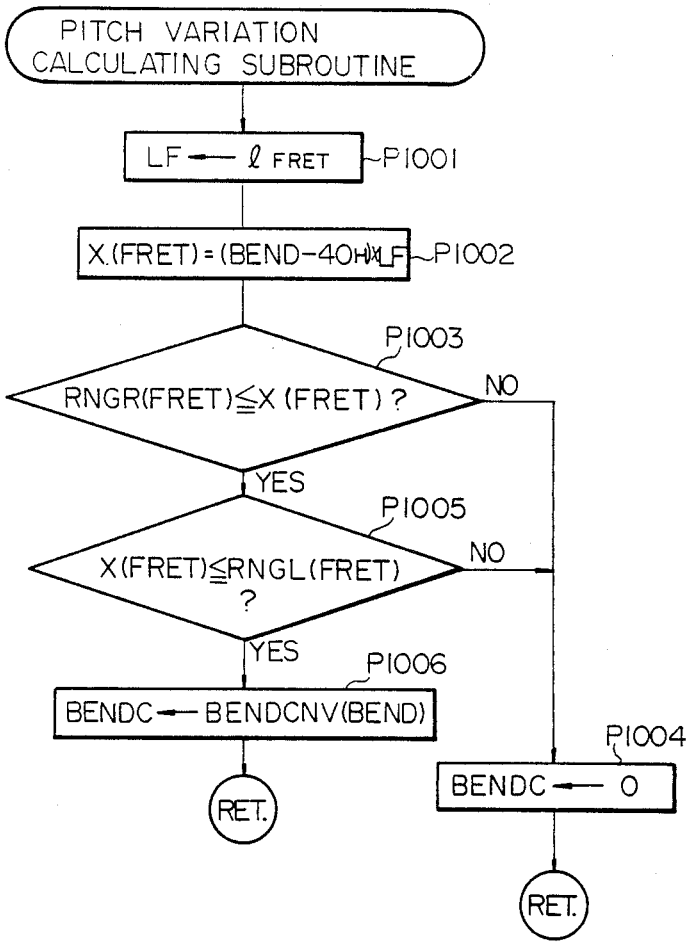
FIG. 17 is a flowchart showing the sequence of a pitch variation calculating subroutine program executed by the central processing unit.

Tables RNGR and RNGL store limitation values at the rightmost positions and the leftmost positions, respectively, and the limitation values are decided for every fret position because the fret members are decreased in width toward the leading end of the neck portion 102. The limitation value at the rightmost position is by way of example represented as RNGR(FRET) and used in the pitch variation calculating subroutine program shown in FIG. 17.

One of the tables stores a set of digital bit strings I0 to I24 representing distances from the tailpiece 119 to the respective fret members 109 to 112 and one more digital bit string IBEND representative of a distance between the tailpiece 119 and the bend sensors 120 to 126. In this instance, the digital bit strings I0 to I24 and $I_{BEND}$ has respective values corresponding to the distances indicated in Table 3.

Another table stores a set of digital bit strings $1_0$ to $1_{24}$ representing distances between the piezo electric transducers 120 to 126 and the fret members 109 to 112.

TABLE 3

| bit string: | I0 | I1 | I2 | I3 | ... | I23 | I24 | $I_{BEND}$ |
|---|---|---|---|---|---|---|---|---|
| distance (mm): | 691 | 657 | 623 | 592 | | 228 | 219 | 50 |

Mainroutine program

Referring to FIG. 9 of the drawings, there is illustrated the mainroutine program executed by the central processing unit 401. When the main switch is operated for activation of the electronic stringed musical instrument, a timer interruption is prohibited, and the central processing unit 401 executes steps P1 and P2 for loading respective initial values into the data registers 403. Namely, in the step P1, the central processing unit 401 gives the repetition data information N and the accumulation data information to value "0", however, the mode data information MODE is shifted to value "1". In the step P2, value "0" is provided for the time control data information PCKCNT, the previous peak value data information OPCk, the maximum peak value data information PEAK, the mute count data information MUTECNT, the temporal fret position data information NFRET and the producible key code data information OKC, and the key-on trigger flag information ONTRG is lowered to have value "0". Thus, the mode data information MODE is set to value "0", and, for this reason, the central processing unit 401 executes a bend sensor self-adjusting mode of operation after the first timer interruption. When the step P2 is completed, the central processing unit 401 proceeds to step P3 and is released for the timer interruption. After the timer interruption is allowed, with the interrupt clock signal CL, the central processing unit 401 executes the timer interruption program sequence shown in FIG. 10, and returns from one of subroutine programs forming part of the timer interruption program sequence to the mainroutine program. However, the description is continued for the mainroutine program as if no timer interruption takes place for the sake of simplicity.

When the step 3 is completed, the central processing unit proceeds to step P4 to check into the data registers 403 to see whether or not the mode data information has value "0". If the answer to the step 4 is given in the negative, the electronic stringed musical instrument is in one of the self-adjusting modes of operation, then central processing unit 401 repeats the step P4 until the self-adjusting modes of operation are completed. However, if the answer to the step P4 is given in the positive, the electronic stringed musical instrument has been shifted to the playing mode of operation, then the central processing unit 401 proceeds to step P5 to check into the switch board to see whether or not the legato switch is operated. If the answer to the step P5 is given in the positive, the legato mode flag is altered, and, for this reason, the legato mode flag information LGT shifts the value thereof as step P6. In detail, if the player operates the legato switch for providing the legato to sounds, the legato mode flag information MPL shifts the value thereof from "0" to "1". However, when the player wants to terminate the provision of the legato, the legato mode flag information MPL shifts the value thereof from "1" to "0". Upon completion of the step P6, the central processing unit 401 proceeds to step P7. On the other hand, if the answer to the step P5 is given in the negative, the central processing unit proceeds to the step P7 to check into the switch board 139 to see whether or not the left-hand switch is operated. If the answer to the step P7 is given in the positive, the left-hand flag is altered, and, for this reason, the left-hand mode flag information LEFT shifts the value thereof as step P8. In detail, if the player operates the left-hand switch for producing sounds with the left hand only, the left-hand mode flag information LEFT shifts the value thereof from "0" to "1". However, when the player wants to terminate the left-hand mode of operation, the left-hand mode flag information LEFT shifts the value thereof from "1" to "0". Upon completion of the step P8, the central processing unit 401 proceeds to step P9. On the other hand, if the answer to the step P7 is given in the negative, the central processing unit proceeds to the step P9. In the step P9, other jobs are performed to, for example, select a tone color and adjust the volume of sound. When the step P9 is completed, the central processing unit 401 proceeds to step P10 to check into the switch board 139 to see whether or not the initialization switch is operated. If the initialization switch is operated, the central processing unit 401 proceeds to step P11, and the timer interruption is prohibited. Thus, the timer interruption is disallowed at the step P11, then the central processing unit 401 returns to the step P1 to repeat the steps P1 to P4 and, further, steps P200, P300 and P400. The steps P200, P300 and P400 will be described hereinunder in connection with the timer interruption program sequence. On the other hand, the answer to the step P10 is given in the negative, the central processing unit 401 returns to the step P5 and reiterates the loop consisting of the steps P5 to P10 until the answer to the step P10 is given in the positive.

Timer interruption program sequence

As described hereinbefore, the clock generating unit 405 periodically produces the interrupt clock signal CL at every time interval of about 1 mili-second. The interrupt clock signal CL is supplied to the central processing unit 401, and, for this reason, the timer interruption takes place at every time interval of about 1 mili-second. Although the description is hereinunder made for one of the strings 103 to 108, the central processing unit 401 executes the timer interruption program sequence for every string by using, for example, a time sharing controlling technique.

Figure 13:
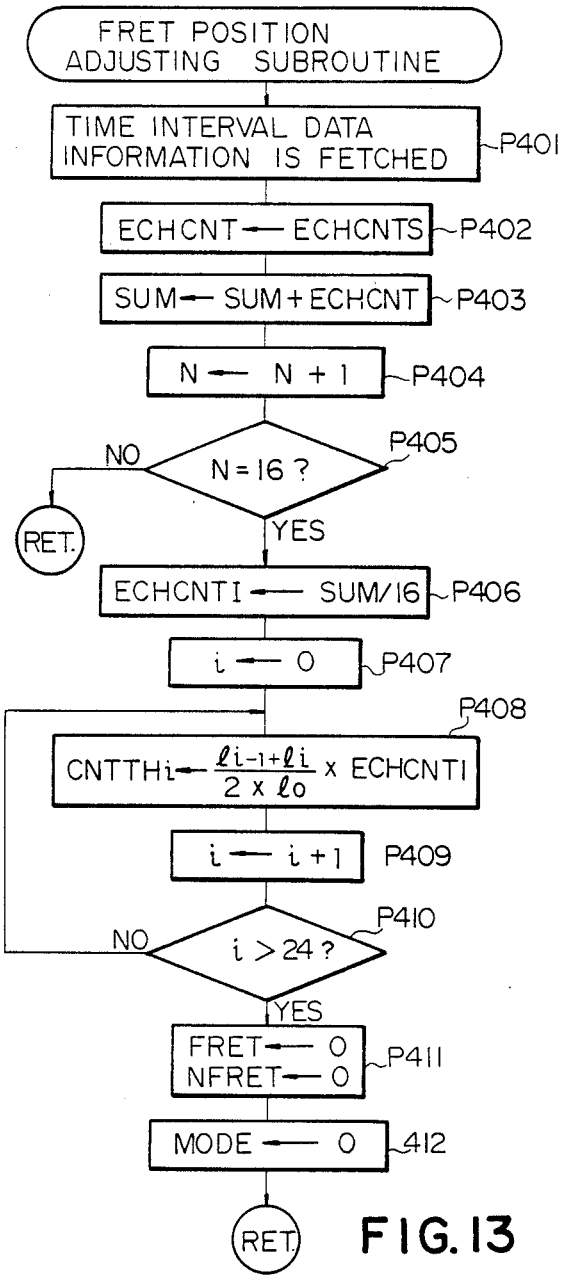
FIG. 13 is a flowchart showing the sequence of a fret position adjusting subroutine program executed by the central processing unit.

When the timer interruption takes place, the central processing unit 401 begins to execute the timer interruption program sequence from step P100. In the step P100, the central processing unit 401 checks into the data registers 403 to see what value is given to the mode data information MODE. If it is found that the mode data information MODE has value "0", the central processing unit 401 proceeds to fret position deciding subroutine program P500 illustrated in FIG. 13 which will be described hereinunder in detail.

Figure 11:
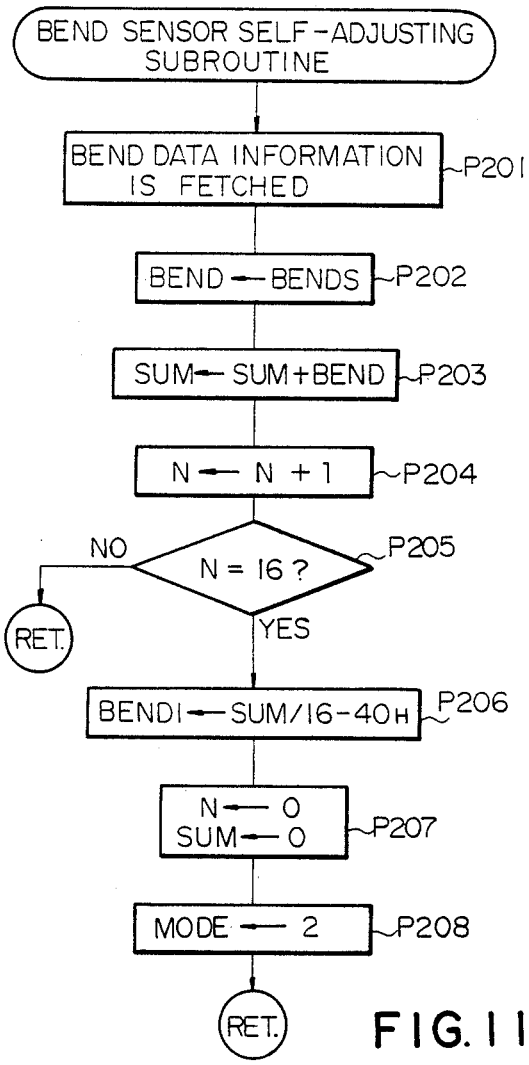
FIG. 11 is a flowchart showing the sequence of a bend sensor self-adjusting subroutine program executed by the central processing unit.

If it is found that the mode data information has value "1", the central processing unit 401 executes the bend sensor self-adjusting subroutine program which is illustrated in FIG. 11. The mode data information MODE is initially set to value "1" at the step P1 in the mainroutine program, and, for this reason, the central processing unit 401 firstly executes the bend sensor self-adjusting subroutine program after the main switch on event.

Bend sensor self-adjusting subroutine program

The bend sensor self-adjusting subroutine program starts from step P201 where the bend data information BENDS is transferred from the register 708 to the data registers 403 for memorization therein. Then, the bend sensor data information BEND is stored in the data registers 403 as step P202. Then, the accumulation data information is accessed, and the value of the accumulation data information SUM is then added to the value to the bend sensor data information BEND. The accumulation data information SUM thus increased in value is memorized into the data registers 403 again as step P203. After the main switch on event, the accumulation data information SUM is set to value "0" at step P1, so that the accumulation data information SUM is increased to the value equal to the bend sensor data information BEND in the first processing stage immediately after the step P3.

The central processing unit 401 increments the repetition data information by one as step P204 and, then, proceeds to step P205 to see whether or not the repetition data information N is equal in value to sixteen as step P205. If the repetition data information N is less than sixteen, the central processing unit is returned to the timer interruption program sequence and, then, to the mainroutine program. While the central processing unit 401 repeats the step P4, the timer interruption takes place again, then the central processing unit executes the timer interruption program sequence from the step P100 and, further, to the bend sensor self-adjusting subroutine program with the mode data information of value "1". The central processing unit 401 repeats the steps P201 to P204 and decides whether or not the repetition data information N is equal to sixteen at the step P205. However, the repetition data information N is less than sixteen in the second processing stage and, accordingly, returns to the timer interruption program sequence and, then, to the mainroutine program. Thus, the central processing unit 401 repeats the loop consisting of the steps P201 to P205, P4, P100 and P200 until the answer for the decision step P205 turns affirmative. When the answer to the decision step P205 is given in the positive, the steps P201 to P203 are repeated sixteen times, then the central processing unit 401 proceeds to step P206 to divide the value of the accumulation data information SUM by sixteen for calculating the average. As described in conjunction with FIG. 8, the neutral position has value of $40_H$, then the central processing unit subtracts $40_H$ from the average, thereby forming the bend correcting data information BENDI.

Upon completion of the step P206, the central processing unit 401 proceeds to step P207 to establish the repetition data information N and the accumulation data information SUM to value "0" again. Then, the mode data information MODE is increased to value "2" as by step P208, and the central processing unit 401 returns to the timer interruption program sequence and, further, to the mainroutine program.

Echo level self-adjusting subroutine program

Figure 12:
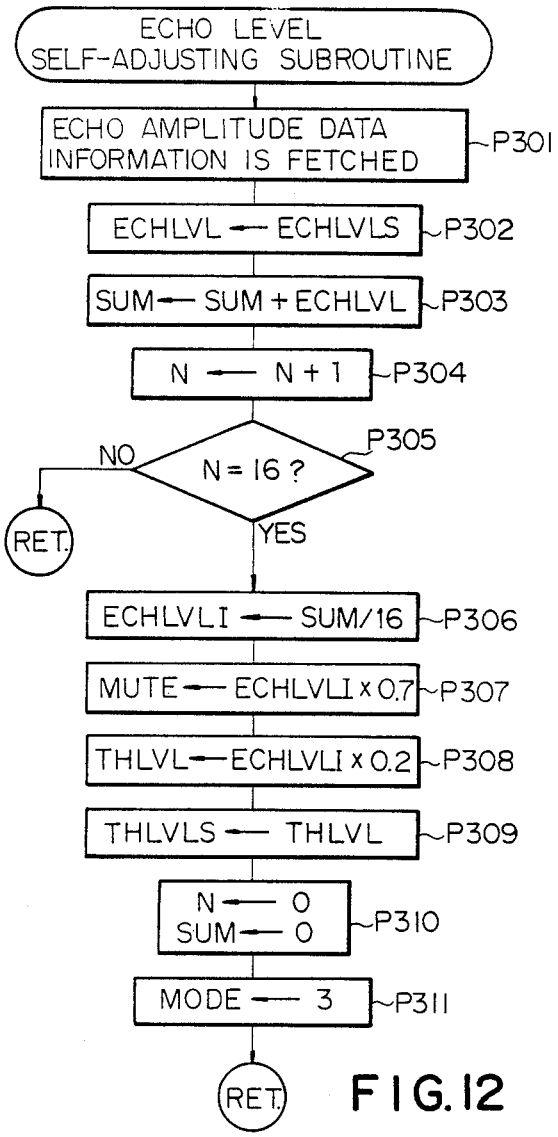
FIG. 12 is a flowchart showing the sequence of an echo level self-adjusting subroutine program executed by the central processing unit.

After the mode data information is increased in value to two, if the timer interruption takes place, the answer to the decision step P300 causes the central processing unit to proceed to the step P300. Thus, the echo level self-adjusting subroutine program P300 is executed as illustrated in FIG. 12. The echo level self-adjusting subroutine program starts from step P301 where the echo amplitude data information ECHLVLS is fetched from the register 521. The echo amplitude data information ECHLVLS is memorized in the data registers 403 as the peak level data information ECHLVL as by step P302, and the accumulation data information SUM, which currently has value "0", is added to the peak level data information ECHLVL. After the calculation, the accumulation data information SUM is stored in the data register 403 as by step P303, and the repetition data information N is incremented by one as by step P304. The central processing unit 401 proceeds to step P305 to see whether or not the repetition data information N is equal in value to sixteen. If the repetition data information N is less than sixteen, the central processing unit is returned to the timer interruption program sequence and, then, to the mainroutine program. While the central processing unit 401 repeats the step P4, the timer interruption takes place again, then the central processing unit 401 executes the timer interruption program sequence from the step P100 and, further, to the echo level self-adjusting subroutine program with the mode data information of value "2". The central processing unit 401 repeats the steps P301 to P304 and, then, decides whether or not the repetition data information N is equal to sixteen at the step P305. However, the repetition data information N is less than sixteen in the second processing stage and, accordingly, returns to the timer interruption program sequence and, further, to the mainroutine program. Thus, the central processing unit 401 repeats the loop consisting of the steps P301 to P305, P4, P100 and P300 until the answer for the decision step P305 turns affirmative. When the answer to the decision step P305 is given in the positive, the steps P301 to P303 are repeated sixteen times, then the central processing unit 401 proceeds to step P306 to divide the value of the accumulation data information SUM by sixteen for calculating the average. The average thus calculated is stored in the data registers 304 as the non-pressing state level data information ECHLVLI.

After memorization of the non-pressing state level data information ECHLVLI, the mute threshold data information MUTE is calculated by multiplying the value of the non-pressing state level data information ECHLVLI by 0.7 as by step P307. The mute threshold data information MUTE is also stored in the data registers 304. In the next step, the echo discriminating threshold data information THLVL is calculated on the basis of the non-pressing state level data information ECHLVLI. The value of the non-pressing state level data information ECHLVLI is multiplied by 0.2 as step P308. Then, the echo discriminating threshold data information THLVL thus calculated is transferred to the data register 304, and the echo discriminating threshold data information THLVL thus memorized in the data registers 304 in turn is transferred to the register 522 for used in the playing mode of operation as by step P309.

Thus, the non-pressing state level data information ECHLVLI, the mute threshold data information MUTE and the echo discriminating threshold data information THLVL are formed, then the central processing unit 401 proceeds to step P310 to establish the repetition data information N and the accumulation data information SUM to value "0" again. Then, the mode data information MODE is increased to value "3" as by step P311, and the central processing unit 401 returns to the timer interruption program sequence and, further, to the mainroutine program.

Fret position adjusting subroutine program

The mode data information MODE is increased to value "3" at step P311, and, for this reason, the central processing unit 401 executes the fret position adjusting subroutine program P400 after the subsequent timer interruption. In the fret position adjusting subroutine program P400, the time interval data information ECHCNTS is fetched from the register 518 as by step P401, and the time interval data information ECHCNTS is memorized into the data registers 304 as the interval data information ECHCNT at the subsequent step P402. In step P403, the accumulation data information SUM, which currently has value "0", is added to the interval data information ECHCNT. After the calculation, the accumulation data information SUM is stored in the data register 403, and the repetition data information N is incremented by one as by step P404. The central processing unit 401 proceeds to step P405 to see whether or not the repetition data information N is equal in value to sixteen. If the repetition data information N is less than sixteen, the central processing unit is returned to the timer interruption program sequence and, then, to the mainroutine program. While the central processing unit 401 repeats the step P4, the timer interruption takes place again, then the central processing unit 401 executes the timer interruption program sequence from the step P100 and, further, to the basic fret position data forming subroutine program with the mode data information of value "3". The central processing unit 401 repeats the steps P401 to P404 and, then, decides whether or not the repetition data information N is equal to sixteen at the step P405. However, the repetition data information N is less than sixteen in the second processing stage and, accordingly, returns to the timer interruption program sequence and, further, to the mainroutine program. Thus, the central processing unit 401 repeats the loop consisting of the steps P401 to P405, P4, P100 and P400 until the answer for the decision step P405 turns affirmative. When the answer to the decision step P405 is given in the positive, the steps P401 to P403 are repeated sixteen times, then the central processing unit 401 proceeds to step P406 to divide the value of the accumulation data information SUM by sixteen for calculating the average. The average thus calculated is stored in the data registers 304 as the zero fret position data information ECHCNTI.

Figure 14:
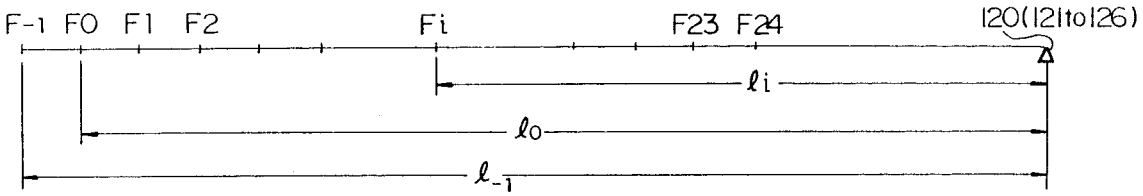
FIG. 14 is a diagram showing the relationship between the fret position and the distance from a piezo electric transducer installed in the electronic stringed musical instrument shown in FIG. 1.

Thus, the zero fret position data information ECHCNTI is actually measured, then value "0" is given to the index parameter i as by step P407. Subsequently, the central processing unit 401 calculates the fret boundary data information CNTTHi for each fret position as in step P408. As will be understood from FIG. 14, the fret members 109, 110, . . . , 111 and 112 are labeled as F0, F1, . . . , F23 and F24, and the fret member 120 is assumed to be spaced apart from the piezo electric transducer 120 by a distance $l_0$, then the fret boundary data information CNTTHi for an arbitrary fret member Fi is calculated as $$CNTTHi=(l_{i-1}+l_i)/(2\times l_0)\times ECHCNTI$$

where $(l_{i-1}+l_i)/2$ represents the distance between the piezo electric transducer 120 and the mid of the adjacent fret members. Then, the boundary data information CNTTHi is calculated by the proportional allotment of the value of the zero fret position data information ECHCNTI. All of the distances $l_i$ from the piezo electric transducer 120 are fixedly stored in one of the tables 404. Additionally, a virtual fret position $F_{-1}$ is illustrated in FIG. 14 and is located beyond the zero fret position F0.

Turning back to FIG. 13, value "0" has been given to the index parameter i at step P407, then the boundary data information CNTTHi is calculated for the virtual fret position $F_{-1}$ in the first processing stage of the basis fret position data forming subroutine program. The boundary data information $CNTTH_{-1}$ is transferred to the data registers 403 for storage, and the index parameter i is incremented by one as in step P409. It is queried at step P410 whether or not the index parameter i is less than twenty-four. If it is found that the index parameter i is less than twenty-four, the central processing unit 401 returns to the step P408 to form the boundary data information for the subsequent fret position $F_{i+1}$. Thus, the central processing unit 401 reiterates the loop consisting of the step P408 to P410 until the answer for the decision step P410 turns affirmative. Since the electronic stringed musical instrument has twenty-four fret positions, the answer to the decision step P410 is given in the positive after the boundary data information CNTTHi is formed for every fret position Fi. If it is found that the answer for the decision step P410 turns affirmative, value "0" is given for each of the fret position data information FRET and the temporal fret position data information NFRET as by step P411. Subsequently, the mode data information MODE is shifted to value "0" for allowing the electronic stringed musical instrument to operate in the playing mode of operation as by step P412. Then, the central processing unit 401 returns to the timer interruption program sequence and, further, to the mainroutine program. Since value "0" has been given to the mode data information MODE, the answer to the decision step P4 of the mainroutine program is given in the positive, the central processing unit proceeds to the step P5 and reiterates the loop consisting of the steps P5 to P10 until the initialization switch is operated.

Playing mode of operation

Figure 15A:
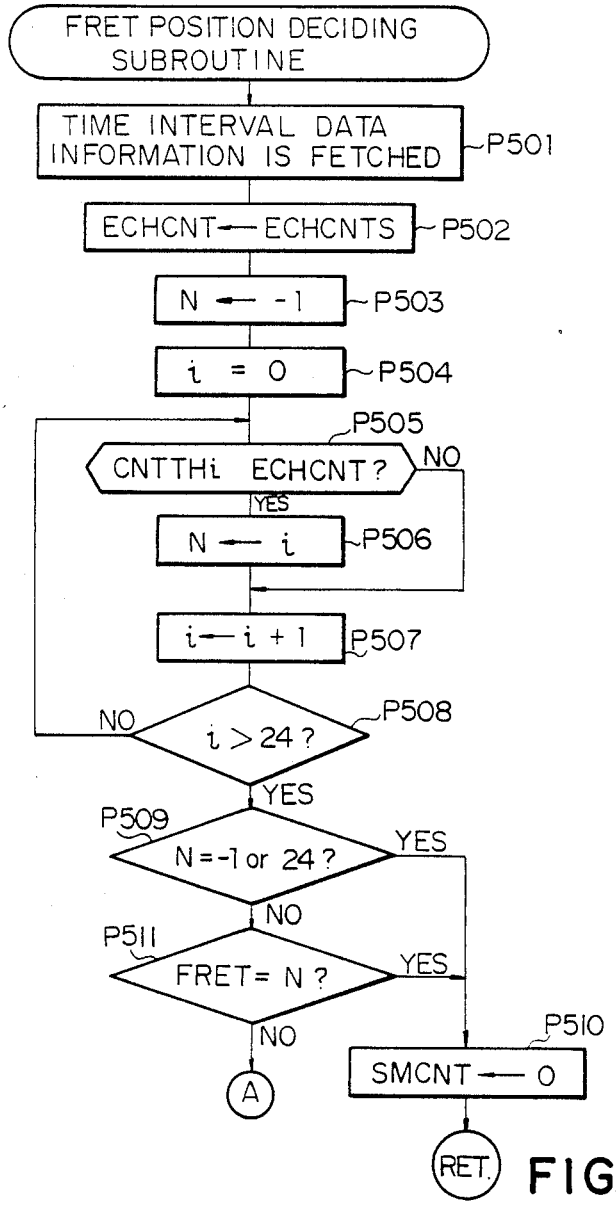
FIGS. 15A and 15B are flowcharts showing the sequence of a fret position deciding subroutine program executed by the central processing unit.
Figure 15B:
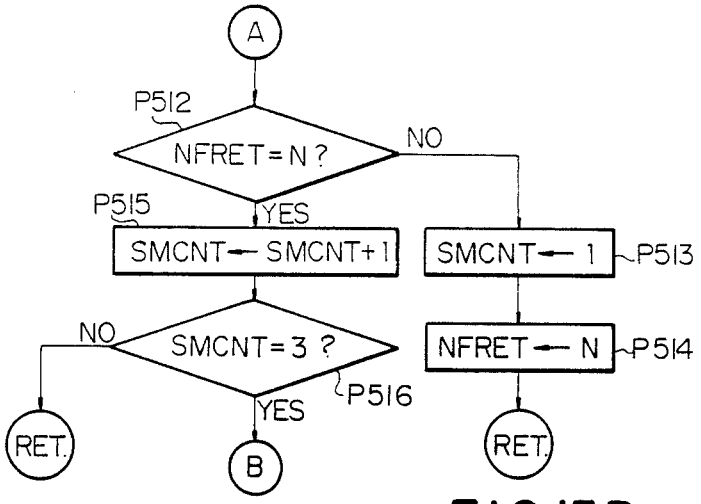
Figure 15C:
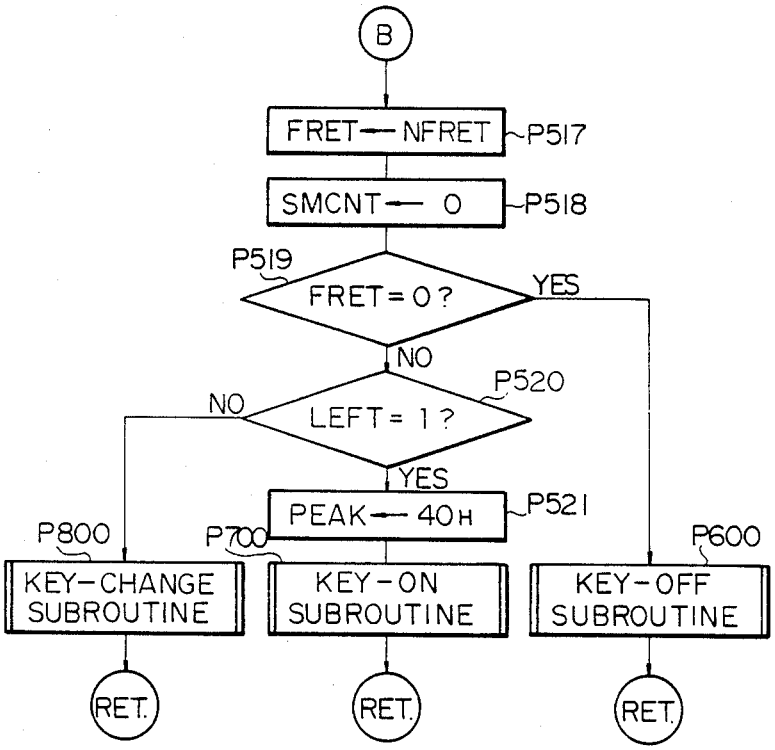

If the timer interruption takes place during the loop consisting of the steps P5 to P10, the answer to the step P100 of the timer interruption program sequence leads the central processing unit 401 to the fret position deciding subroutine program P500 the detailed program sequence of which is illustrated in FIGS. 15A and 15B. After the completion of the fret position deciding subroutine program P500, the central processing unit 401 proceeds to a series of subroutine programs. In the fret position deciding subroutine program, the central processing unit 401 compares the interval data information ECHCNT with the boundary data information CNTTHi and, accordingly, decides the fret position assigned to the fret member which comes in contact with the string. In this instance, if the decision is identical through the comparison repeated three times, the fret position is confirmed. After the confirmation of the fret position, the central processing unit 401 proceeds to one of a key-off subroutine program P600, a key-on subroutine program P700 and a key-change subroutine program P800 depending upon the left-hand mode flag information.

The fret position deciding subroutine program P500 is followed by a bend operation detecting subroutine program P 900 in which the central processing unit decides whether or not the bend data information BENDS is valid, and a variation in pitch is specified on the basis of the bend curve which has been already selected if valid. The variation in pitch is transferred to the tone generator unit 2. After the completion of the bend operation detecting subroutine program P900, the central processing unit 401 proceeds to a plucking motion detecting subroutine P1100 for deciding on the basis of the peak value data information PICKUPS whether or not the string is plucked by the player. In this instance, the peak value data information is successively decreased in value through comparing repeated three times, then the central processing unit 401 decides that the string is plucked and, accordingly, proceeds to the key-on subroutine program.

A muting technique detecting subroutine program P1200 is executed after the plucking motion detecting subroutine program P1000, the muting technique is detected in such a manner that the peak level data information ECHLVL is smaller in value than the mute threshold data information MUTE when the mute count data information MUTECNT is decreased to the minimum value of zero. Whenever the muting technique is detected, the central processing unit 401 immediately executes the key-off subroutine program.

Thus, the central processing unit 401 periodically executes the subroutine programs P500 to P1200 in response to the timer interruption and, accordingly, produces various instructions so as to cause the tone generator unit 2 to produce sounds in accordance with the performance made by the player.

Now, description is firstly made for the fret position deciding subroutine program with reference to FIGS. 15A and 15B.

Fret position deciding subroutine program

In the beginning of the fret position deciding subroutine program P500, the time interval data information ECHCNTS is fetched from the register 518 as by step P501, and the time interval data information ECHCNTS is memorized in the data registers 403 as the interval data information ECHCNT as by step P502. Value "−1" is given to the repetition data information N in step P503, and the index parameter i is established to value "0" as by step P504. With the index parameter i, the central processing unit 401 accesses the boundary data information CNTTHi, which is currently specified as $CNTTH_{-1}$ established for the virtual fret position $F_{-1}$, and compares the interval data information ECHCNT with the boundary data information CNTTHi as by step P505. If it is found that the boundary data information CNTTHi is greater than the interval data information ECHCNT, the fret boundary data information CNTTHi is different from the fret boundary data information assigned to the fret contacting the string. Then, the central processing unit 401 proceeds to step P506 for establishing the repetition data information N to the value identical with the index parameter i. Then, the central processing unit 401 proceeds to step P507 to increment the index parameter i by one, and the central processing unit 401 proceeds to step P508 to see whether or not the index parameter i is greater in value than twenty-four. If the answer to the decision step P508 is given in the negative, the central processing unit 401 returns to the step P505 to compare the time interval data information ECHCNT with the fret boundary data information CNTTHi established for the next fret position. Thus, the central processing unit reiterates the loop consisting of the steps P505 to P508, and the interval data information ECHCNT is sequentially compared with the fret boundary data information CNTTHi until the answer for the decision step P505 is given in the negative. When the fret boundary data information CNTTHi is not larger in value than the interval data information ECHCNT, the answer to the decision step P505 is given in the negative, then the central processing unit 401 proceeds to the step P507 without the execution of the step P506 and repeats the loop consisting of the step P505, P507 and P508 until the answer for the decision step turns affirmative. When the answer to the decision step P508 is given in the positive, every fret boundary data information has been compared with the interval data information ECHCNT, however, the repetition data information N indicates the fret position Fi where the central processing unit 401 decides that the string is pressed thereon.

After the completion of the step P508, the central processing unit 401 proceeds to step P509 to see whether or not the repetition data information has been given to value "−1" or value "24". As described above, the virtual fret position $F_{-1}$ is not indicative of any actual fret member, and no note is assigned to the fret position F24. For this reason, the central processing unit 401 decides that the interval data information is indicative of an error, then the central processing unit 401 proceeds to step P510 for shifting the repetition data information to value "0". Thus, value "0" is given to the repetition data information, no sound is produced on the basis of the echo of the super-sonic frequency vibration which is causative of the interval data information ECHCNT. After completion of the step P510, the central processing unit 401 returns to the timer interruption program sequence.

On the other hand, if the answer to the decision step P509 is given in the negative, the central processing unit 401 proceeds to step P511 to see whether or not the fret position data information FRET is identical in value with the repetition data information N. If it is found that the fret position data information is identical in value with the repetition data information N, the player continues to press the string on the fret member which has been already confirmed in the previous fret position deciding operation, then the central processing unit 401 proceed to the step P510 without any execution of the key-on subroutine program to give value "0" to the repetition data count information SMCNT, then returning to the timer interruption program sequence. However, if it is found that the fret position data information FRET is different in value from the repetition data information N, the central processing unit compares the repetition data information N with the temporal fret position data information NFRET to see whether or not the repetition data information N is identical in value with the temporal fret position data information NFRET as by step P512. If it is found that the repetition data information N is different in value from the temporal fret position data information NFRET, value "1" is given to the repetition number count data information SMCNT as by step P513, and the temporal fret position data information NFRET is established to be identical in value with the repetition data information N as by step P514, then returning to the timer interruption program sequence. On the other hand, if the answer to the decision step P512 is given in the positive, the repetition number count data information SMCNT is incremented by one as by step P515, then the central processing unit 401 proceeds to step P516 to see whether or not value "3" is given to the repetition number count data information SMCNT. If the answer to the decision step P516 is given in the negative, no fret position Fi is still confirmed, then the central processing unit 401 returns to the timer interruption program sequence. However, if it is found that value "3" has been already given to the repetition number count data information, the fret position is confirmed three times, then central processing unit 401 proceeds to step P517 to establish the fret position data information FRET to be identical in value with the temporal fret position data information NFRET.

Thus, the fret position Fi is confirmed, then the central processing unit 401 gives value "0" to the repetition number count data information SMCNT for the subsequent fret position deciding operation as by step P518 and, thereafter, proceeds to step P519 to see whether or not the fret position data information FRET is indicative of the fret member 109 ( or zero fret member ). If it is found that the fret position data information FRET is given value "0", the fret position Fi is indicative of the zero fret member 109. This means that the pressing force is removed from the string to shift into the non-pressing state, then the central processing unit 401 executes the key-off subroutine program P600 which will be described in detail.

On the other hand, if the answer to the decision step P519 is given in the negative, the central processing unit 401 check the data registers 403 at step P520 to see whether or not the left-hand mode flag information LEFT is indicative of value "1" If the answer to the decision step P520 is given in the positive, the maximum peak value data information PEAK is given the average tone volume value of $40_H$ for the left-hand mode of operation as by step P521. Then, the central processing unit 401 executes the key-on subroutine program P700 which will be described in detail.

If it is found that no left-hand mode of operation is instructed, the answer to the decision step P520 is given in the negative, then central processing unit 401 executes the key-change subroutine program P800 which will be described hereinafter in detail.

Bend operation detecting subroutine program

Figure 16:
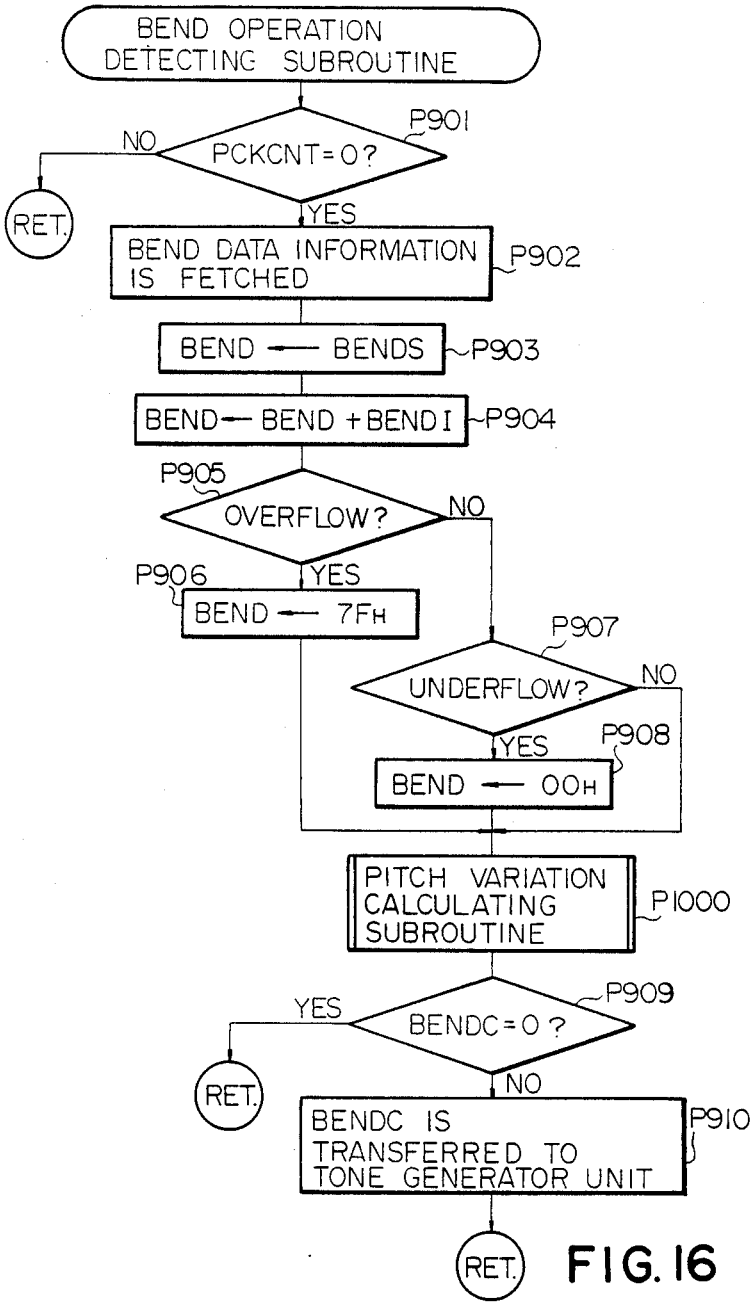
FIG. 16 is a flowchart showing the sequence of a bend operation detecting subroutine program executed by the central processing unit.

Turning to FIG. 16 of the drawings, description is hereinunder made for the sequence of the bend operation detecting subroutine program . The subroutine program starts from step P901 where the central processing unit 401 checks into the data registers 403 to see whether or not the time control data information PCKCNT is indicative of value "0". If it is found that the time control data information PCKCNT is different from value "0", the central processing unit 401 returns to the timer interruption program sequence without any job. Since the time control data information is initially given value "10" as described in connection with each data information stored in the data registers 403, no pitch variation is applied to the sound until the predetermined lapse of time after the plucking motion. This results in discrimination of the bend operation from the large low frequency vibration produced immediately after the plucking motion.

On the e other hand, if the answer to the decision step P901 is given in the positive, the central processing unit 401 proceeds to step P902 and the bend data information BENDS is fetched from the register 708. The bend data information BENDS is transferred to the data registers 403 for establishing the bend sensor data information BEND as by step P903. After the establishment of the bend sensor data information, the value represented by the bend correcting data information BENDI is added to the value represented by the bend sensor data information BEND as by step P904. If an overflow tales place in the total value, the answer to decision step P905 is given in the positive, then the maximum value of $7F_H$ is given to the bend sensor data information BEND as by step P906. On the other hand, no overflow takes place in the total value, the central processing unit proceeds to step P907 to see whether or not an underflow takes place in the total value. If it is found that the underflow takes place in the total value, the bend sensor data information is given the minimum value of $00_H$ as by step P908. After the completion of either step P906 or P908, the central processing unit 401 proceeds to step P1000 where the central processing unit 401 executes the pitch variation calculating subroutine program illustrated in FIG. 17. If the answer to the decision step P907 is given in the negative, the central processing unit 401 also proceeds to the step P1000.

Figure 18:
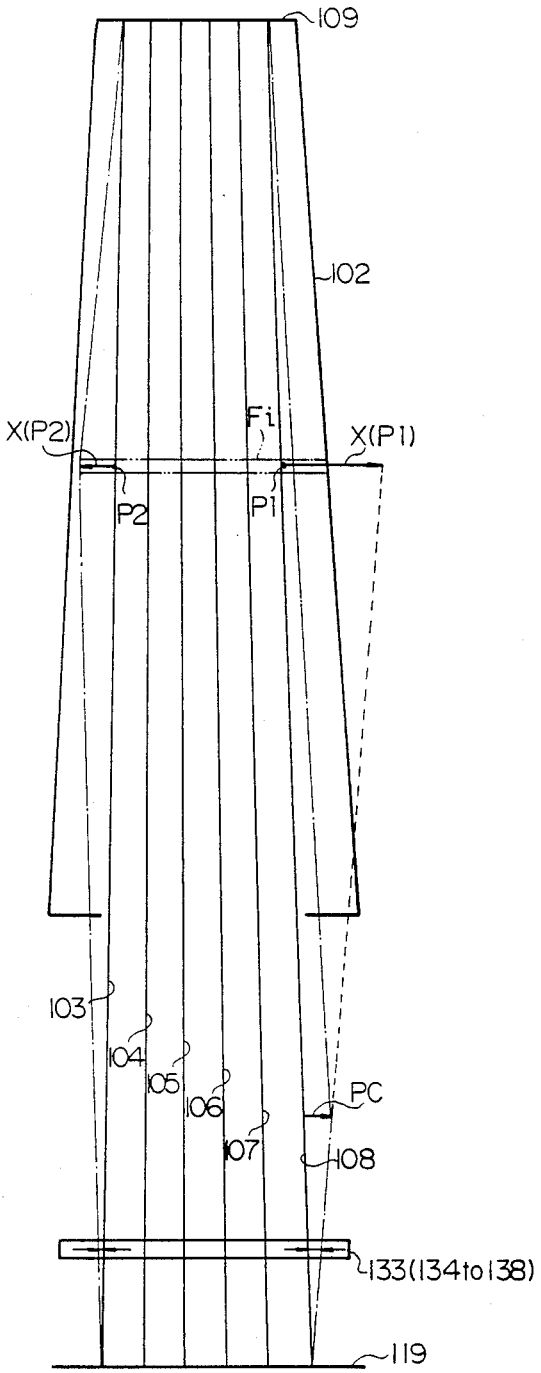
FIG. 18 is a plan view for the explanation of string deviations due to the plucking motion and the bent-string playing technique.

Prior to the detailed description for the pitch variation calculating subroutine program, description is made for a virtual deviation with reference to FIG. 18. FIG. 18 schematically shows the electronic stringed musical instrument. Assuming now that a deviation PC ( which is referred to as "plucking deviation") takes place due to a plucking motion and that the strings 103 and 108 are pressed against the neck portion 102 at points P1 and P2, respectively, the string deviation X(P1) produced at the point P1 due to the plucking deviation can be calculated on the basis of the bend sensor data information BEND and excesses the width of the neck portion 102. On the other hand, if the string 103 is bent by the player at the point P2, the string deviation X(P2) at the point P2 is also calculated on the basis of the bend sensor data information BEND and remains within the width of the neck portion 102. Thus, it is capable to discriminate the string deviation due to the bend operation from the string deviation due to the plucking motion by calculating the string deviation X(Pi) which is referred to as "virtual deviation" and defined by the following equation.

$$X(Pi) = (BEND - 40_H) \times LF$$

Since the value calculated from ( $BEND - 40_H$) corresponds to the angle produced in the string, the above equation yields the virtual deviation. If the virtual deviation thus calculated is larger that the width of the neck portion, no bend operation takes place in the string, and, for this reason, any pitch variation should not be applied to the sound. On the other hand, if the virtual deviation is not larger than the width of the neck portion 102, the sound currently produced should be varied in pitch on the basis of the bend operation actually made by the player.

Turning back to FIG. 17 of the drawings, the pitch variation calculating subroutine program starts from step 1001 where the central processing unit 401 fetches the distance between the tailpiece 119 and the fret member contacting the string from the tables 404 and establishes the bent-string position data information LF to be identical in value with the distance fetched from the tables 404. Then, the central processing unit 401 calculates the virtual deviation X(FRET) in accordance with the equation ( BEND$-40_H$)×LF as by step P1002 and proceeds to step 1003 to see that the virtual deviation is produced by either of the plucking motion and the bend operation. Namely, the central processing unit 401 compares the virtual deviation X(FRET) with the limitation value RNGR (FRET) at the right side of the neck portion 102 which is fetched from the table RNGR. If the answer t the decision step P1003 is given in the negative, the virtual deviation is assumed to be invalid, then the central processing unit 401 gives value "0" to the pitch variation data information BENDC as by step P1004. When the pitch variation data information BENDC is given value "0", the sound currently produced is not varied in pitch. Then, the central processing unit 401 returns to the bend operation detecting subroutine program.

On the other hand, if the virtual deviation X(FRET) is less than the limitation value RNGR(FRET), the central processing unit 401 proceeds to step P1005 to see whether or not the virtual deviation X(FRET) is less than the limitation value RNGL (FRET) at the left side of the neck portion 102 which is fetched from the table RNGL. If it is found that the virtual deviation X(FRET) is not less than the limitation value RNGL(FRET), the central processing unit 401 also proceeds to the step P1004 to give value "0" to the pitch variation data information BENDC, then returning to the bend operation detecting subroutine program. However, if the answer to the decision step P1005 is given in the positive, the central processing unit 401 proceeds to step P1006 where the pitch variation BENDCNV-(BEND) is calculated from the bend curve previously selected, and the pitch variation data information BENDC is established to be identical in value with the pitch variation BENDCNV(BEND). Then, the central processing unit 401 returns to the bend operation detecting subroutine program.

Turning back to FIG. 16 of the drawings, the central processing unit 401 proceeds to step 909 to see whether or not the pitch variation data information BENDC is indicative of value "0". If it is found that the pitch variation data information is indicative of value "0", the central processing unit 401 immediately returns to the timer interruption program sequence. However, if the answer to the decision step P909 is given in the negative, the pitch variation data information is transferred to the tone generator unit 2 for the variation in pitch of the sound currently produced. Thus, the pitch variation is achieved by the bend operation detecting subroutine program.

Plucking motion detecting subroutine program

Figure 19A:
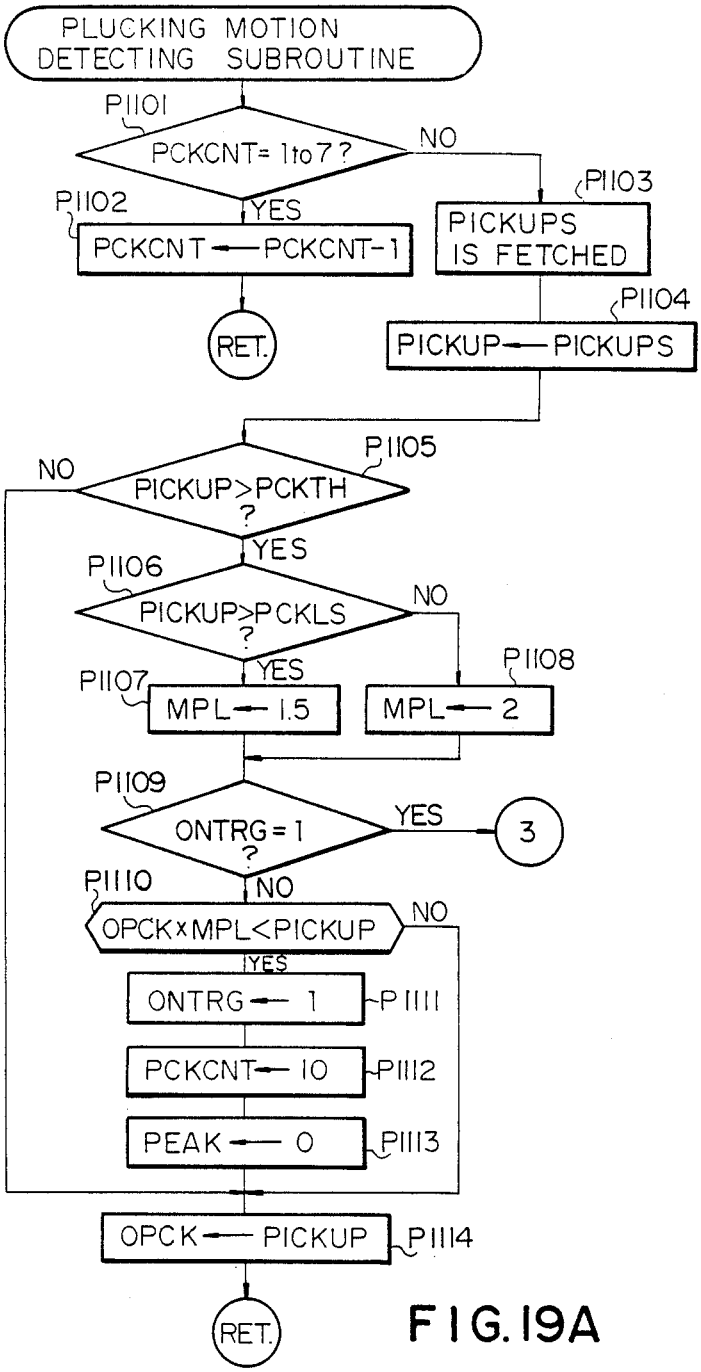
FIGS. 19A and 19B are flowcharts showing the sequence of a plucking motion detecting subroutine program executed by the central processing unit.
Figure 19B:
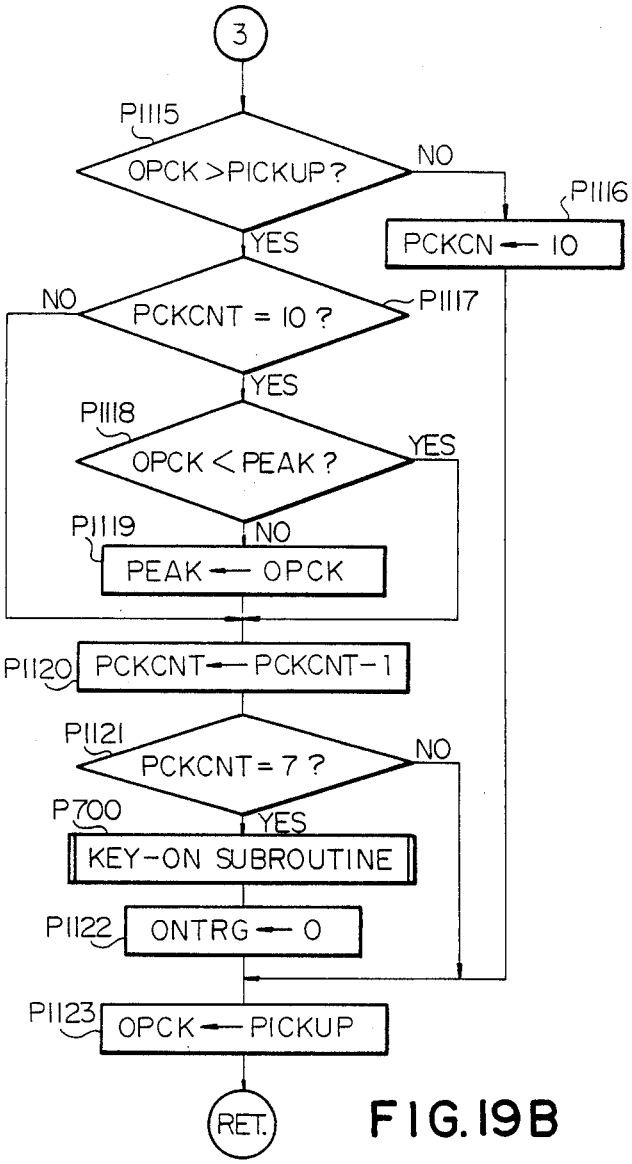

Turning to FIGS. 19A and 19B of the drawings, there is shown the sequence of the plucking motion detecting subroutine program P1100. The subroutine program starts from step P1101 where the central processing unit 401 checks into the data registers 403 to see whether or not the time control data information is indicative of a value ranging between "1" and "7". If it is found that the time control data information ranges between value "1" to value "7", the central processing unit 401 proceeds to step P1102 to decrement the time control data information by one, then returning to the timer interruption program sequence.

On the other hand, the answer to the decision step P1101 is given in the negative, the peak value data information PICKUPS is fetched from the register 607, and, then, the stored peak value data information PICKUP is established to be identical in value to the peak value data information PICKUPS as by step P1104. The stored peak value data information PICKUP is compared in value with the pickup threshold data information PCKTH as by step P1105. If it is found that the stored peak value data information PICKUP is larger in value than the pickup threshold data information PCKTH, the central processing unit 401 decides that the peak value data information PICKUPS is formed on the basis of the noises, then proceeding to step P1114 without execution of steps P1106 to 1113.

On the other hand, if the answer to the decision step P1105 is given in the positive, the stored peak value data information PICKUP is indicative of the receipt of the echo of the supersonic frequency vibration reflected from the fret member contacting the string, then the central processing unit 401 proceeds to the step P1106 to see whether or not the stored peak value data information PICKUP is larger in value than the pickup boundary data information PCKLS. If it is found that the stored peak value data information PICKUP is larger in value than the pickup boundary data information PCKLS, the central processing unit 401 decides that a large low frequency vibration is produced on the string, and, accordingly, value "1.5" is given to the magnification data information MPL as by step P1107. On the other hand, if the answer to the decision step P1106 is given in the negative, the central processing unit 401 decides that a small low frequency vibration takes place on the string, and, for this reason, value "2" is given to the magnification data information MPL as by step P1108.

When the magnification data information MPL is thus determined at either step P1107 or P1108, the central processing unit 401 proceeds to step P1109 to see whether or not the key-on trigger flag information ONTRG is indicative of value "1". If the answer to the decision step P1109 is given in the negative, the value of the previous peak value data information OPCK is multiplied by the value of the magnification data information MPL and the product is compared with the stored peak value data information PICKUP as by step P1110. If it is found that the product is larger in value than the stored peak value data information PICKUP, the key-on trigger flag information ONTRG is shifted to value "1" as by step P1111, and, then, value "10" is given to the time control data information PCKCNT as by step P1112. The central processing unit 401 further give value "0" to the maximum peak value data information PEAK as by step P1113, and the previous peak value data data information OPCK is , then, given the value equal to that of the stored peak value data information PICKUP as by step P1114. However, if the answer to the decision step P1109 is given in the positive, the central processing unit 401 proceeds to step P1115 to see whether or not the previous peak value data information OPCK is larger in value than the stored peak value data information PICKUP. If the stored peak value data information is larger in value than the previous peak value data information OPCK, the answer to the decision step P1115 is given in the negative, then the central processing unit 401 proceeds to step P1116 to give value "10" to the time control data information PCKCNT. This is because of the fact that the low frequency vibration produced on the string is still increased in amplitude. After the completion of the step P1116, the central processing unit 401 proceeds to step P1123 without execution of steps P1117 to P1122 to establish the previous peak value data information OPCK to be identical in value with the stored peak value data information PICKUP.

On the other hand, if the answer to the decision step P1115 is given in the positive, the central processing unit 401 proceeds to step P1117 to see whether or not the time control data information is indicative of value "10". If the answer to the decision step P1117 is given in the positive, the central processing unit 401 further proceeds to step P1118 to see whether or not the maximum peak value data information PEAK is larger in value than the previous peak value data information OPCK. If the maximum peak value data information is not larger than the previous peak value data information, the answer to the decision step P1118 is given in the negative, then the central processing unit 401 proceeds to step P1119 to establish the maximum peak value data information to the identical value of the previous peak value data information OPCK. However, the answer to the decision step P1118 is given in the positive, the central processing unit 401 proceeds to step P1120 without the execution of the step P1119. Similarly, if the answer to the decision step P1117 is given in the negative, the central processing unit 401 proceeds to step P1120 without the execution of the steps P1118 and P1119. In the step P1120, the time control data information PCKCNT is decremented by one, then the central processing unit 401 proceeds to step P1121 to see whether or not the time control data information is indicative of value "7". If the time control data information is larger in value than value "7", it is too early to execute the key-on subroutine program P700, then the central processing unit 401 proceeds to the step P1123 without the execution of the steps P700 and P1122. On the other hand, the time control data information PCKCNT is indicative of value "7", the answer to the decision step P1121 is given in the positive which indicates that it is the time to execute the key-on subroutine program P700, then the central processing unit 401 proceeds to the step P700 and executes the key-on subroutine program as will be described hereinafter in detail. After the completion of the key-on subroutine program P700, value "0" is given to the key-on trigger flag information ONTRG for the subsequent execution of the plucking motion detecting subroutine program. The step P1122 is followed by the step P1123, and the central processing unit 401 returns to the timer interruption program sequence upon the completion of the step P1123.

Muting technique detecting subroutine program

Figure 20:
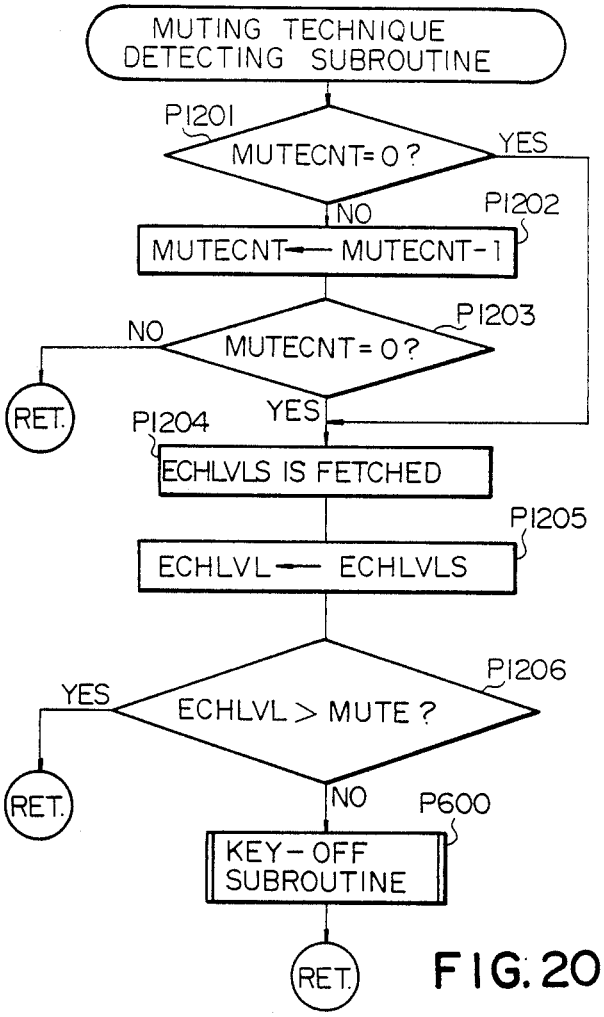
FIG. 20 is a flowchart showing the sequence of a muting technique detecting subroutine program executed by the central processing unit.

Turning to FIG. 20 of the drawings, description is made for the muting technique detecting subroutine program. The subroutine program starts from step P1201 where the central processing unit checks the data registers 403 to see whether or not the mute count data information MUTECNT is indicative of value "0". If the answer to the decision step P1201 is given in the negative, the central processing unit 401 proceeds to step P1202 to decrement the mute count data information MUTECNT by one. Then, the central processing unit 401 checks the mute count data information MUTECNT to see whether or not the value is zero as by step P1203. In this instance, the muting is not achieved until the predetermined lapse of time after the production of the sound. Then, if the mute count data information MUTECNT is indicative of a value larger than zero, the central processing unit 401 returns to the timer interruption program sequence.

However, the answer to the decision step P1203 is given in the positive, the central processing unit fetches the echo amplitude data information ECHLVLS from the register 521 as by step P1204, and then the peak level data information ECHLVL is given the value equal to that of the echo amplitude data information ECHLVLS as by step P1205. Then, the central processing unit 401 checks the peak level data information ECHLVL to see whether or not the peak level data information ECHLVL is larger in value than the mute threshold data information MUTE as by step P1206. If the answer to the decision step P1206 is given in the positive, the central processing unit 401 decides that no muting operation is carried out, then returning to the timer interruption program sequence. On the other hand, if the peak level data information ECHLVL is not larger in value than the mute threshold data information MUTE, the central processing unit 401 proceeds to the step P600 to execute the key-off subroutine program. After completion of the execution of the key-off subroutine program, the central processing unit 401 returns to the timer interruption program sequence.

Key-on subroutine program

Figure 21:
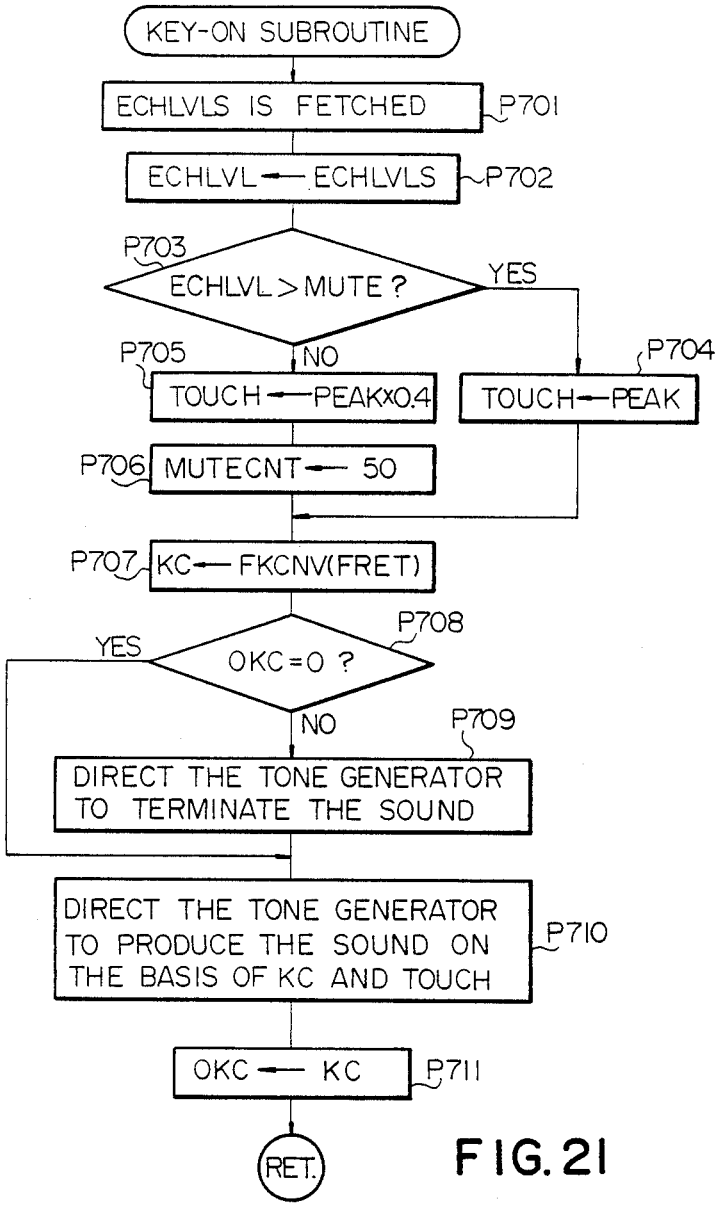
FIG. 21 is a flowchart showing the sequence of a key-on subroutine program executed by the central processing unit.

Turning to FIG. 21 of the drawings, the key-on subroutine program is described in detail. As described hereinbefore, the key-on subroutine program is executed under the left-hand playing technique or under the detection of the plucking motion.

The key-on subroutine program starts from step P701 where the echo amplitude data information ECHLVLS is fetched from the register 521. The echo amplitude data information ECHLVLS is memorized into the data registers 403 as the peak level data information ECHLVL in step P702, then the central processing unit proceeds to step P703 to see whether or not the peak level data information ECHLVL is larger in value than the mute threshold data information MUTE. If it is found that the peak level data information ECHLVL is larger in value than the mute threshold data information MUTE, the central processing unit 401 decides that the sound should be produced on the basis of the ordinary plucking motion. Then, the central processing unit 401 proceeds to step P704 to give the value equal to that of the maximum peak value data information PEAK to the touch data information TOUCH. The maximum peak value data information PEAK is given the standard value of $40_H$ in the left-hand mode of operation, however, when the sound is produced on the basis of the ordinary plucking motion, the peak value data information is identical in value with the stored peak value data information PICKUP. On the other hand, if the answer to the decision step P703 is given in the negative, the central processing unit 401 proceeds to step P705 to multiply the maximum peak value data information PEAK by 0.4. Then, the product is given to the touch data information TOUCH. Thus, if the muting technique is carried out, the sound is produced with a smaller tone volume. After the completion of the step P705, the central processing unit 401 proceeds to step P706 to give value "50" to the mute count data information MUTECNT. The central processing unit fetches the fret position data information FRET from the data registers 403 and, then, accesses the key code FKCNV(FRET) assigned the fret position Fi indicated by the fret position data information FRET. The key code FKCNV(FRET) thus fetched is memorized in the data registers 403 as the key code data information KC as step P707. Then, the central processing unit 401 proceeds to step P708 to see whether or not the producible key code data information OKC is given value "0". If it is found that the producible key code data information OKC is given any value except for zero, the central processing unit 401 decides that the sound system 3 currently produces the sound specified by the producible key code data information OKC, then the central processing unit 401 proceeds to step P709 to direct the tone generator unit 2 to terminate the production of the sound. After the completion of the step P709, the central processing unit 401 transfers the key code data information KC and the touch data information TOUCH to the tone generator unit 2 as by step P710, thereby directing the sound unit 3 to produce the new sound on the basis of the key code data information KC and the touch data information TOUCH. If the answer to the decision step P708 is given in the positive, the sound directed in the previous key-on subroutine program has been already terminated, then the central processing unit 401 proceeds to the step P710 without any execution of the step P709. Thus, after the central processing unit 401 directs the tone generator unit 2 and, accordingly, the sound unit 3 to produce the new sound, the producible key code data information OKC is given the value equal to the key code data information KC as by step P711, then the central processing unit returns to the subroutine program from which being branched.

Key-off subroutine program

Figure 22:
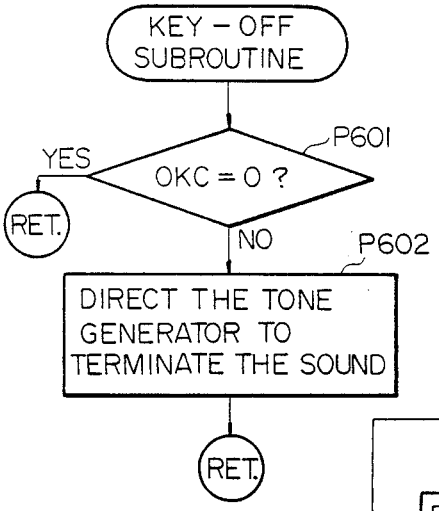
FIG. 22 is a flowchart showing the sequence of a key-off subroutine program executed by the central processing unit.

Description is made for the key-off subroutine program with reference to FIG. 22. The key-off subroutine program is requested in the fret position deciding subroutine program or the muting technique detecting subroutine program. The key-off subroutine program starts from step P601 where the central processing unit 401 checks the producible key code data information to see whether or not value "0" is given thereto. If the answer to the decision step P601 is given in the positive, the sound has been already terminated, then the central processing unit 401 returns to the subroutine program from which being branched. On the other hand, if it is found that the producible key code data information is given any value except for zero, the central processing unit 401 proceeds to step P602 to direct the tone generator unit 2 and, accordingly, the sound unit 3 to terminate the sound with the note specified by the producible key code data information OKC. Then, the central processing unit 401 returns to the subroutine program from which being branched.

Key-change subroutine program

Figure 23:
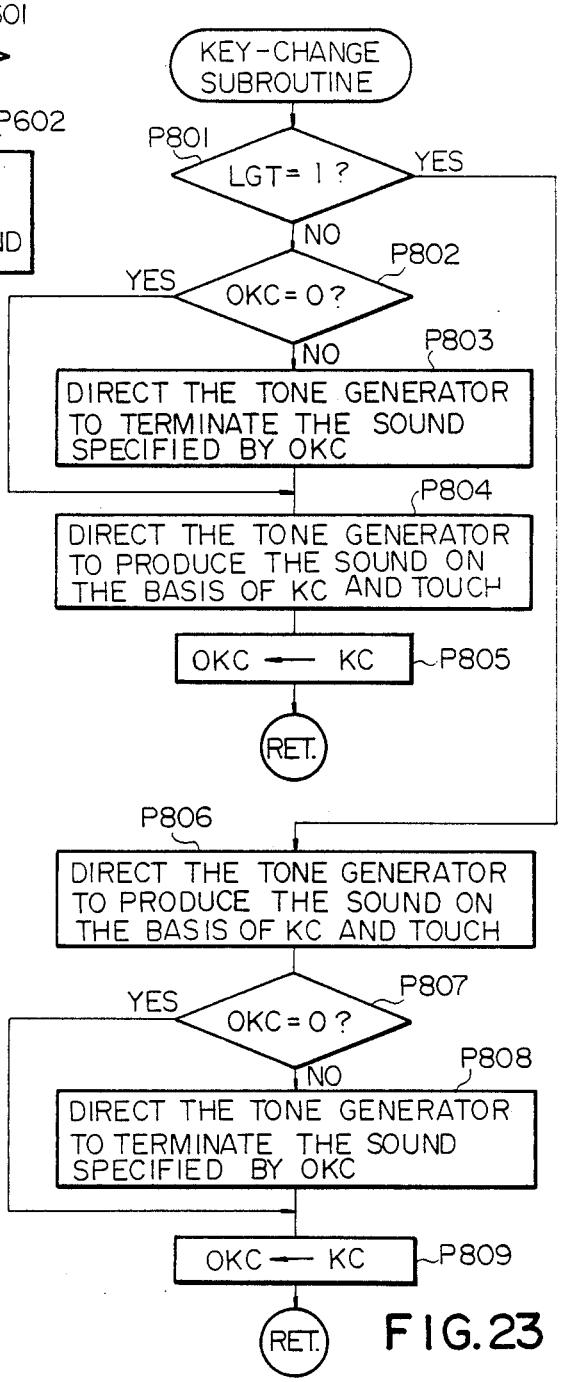
FIG. 23 is a flowchart showing the sequence of a key-change subroutine program executed by the central processing unit.

Turning to FIG. 23 of the drawings, the sequence of the key-change subroutine program is illustrated in detail. The key-change subroutine program is requested in the fret position deciding subroutine program. First, the central processing unit 401 checks into the data registers to see whether or not the legato mode flag information LGT is indicative of value "1". If the legato mode flag information LGT is indicative of value "0", no legato playing technique is directed, then the central processing unit 401 proceeds to step P802 to see whether or not the producible key code data information OKC is indicative of value "0". If the producible key code data information OKC is indicative of any value except for zero, the sound is currently produced by the sound unit 3, then the central processing unit 401 directs the tone generator unit 2 and, accordingly, the sound unit 3 to terminate the sound currently produced as by step P803. Thereafter, the central processing unit directs the tone generator unit 2 to produce the sound on the basis of the key code data information KC and the touch data information TOUCH as by step P804. However, if the answer to the decision step P802 is given in the positive, no sound is currently produced, then the central processing unit 401 proceeds to the step P804 without the execution of the step P803. After the completion of the execution of the step P804, the producible key code data information is given the value equal to that of the key code data information KC as by step P805, then the central processing unit 401 returns to the fret position deciding subroutine program.

On the other hand, the legato mode flag data information LGT is indicative of value "1", the answer to the decision step P801 is given in the positive, then the central processing unit 401 proceeds to step P806 to direct the tone generator unit 2 and, accordingly, the sound unit 3 to produce the sound on the basis of the key code data information KC and the touch data information TOUCH. Then, the central processing unit 401 proceeds to step 807 to see whether or not the producible key code data information OKC is indicative of value "0". If the producible key code data information OKC is indicative of any value except for zero, the central processing unit 401 directs the tone generator unit 2 to terminate the sound with note specified by the producible key code data information OKC as by step P808. Thus, the tone generator unit 2 and, accordingly, the sound unit 3 firstly produces the sound with note specified by the key code data information KC and, thereafter, terminates the sound previously produced on the basis of the producible key code data information OKC, and, for this reason, the sounds are smoothly varied in pitch in accordance with the legato playing technique. After the completion of the execution of the step P808, the producible key code data information OKC is given the value equal to that of the key code data information KC as by step P809, then the central processing unit 401 returns to the fret position deciding subroutine program.

Although particular embodiment of the present invention have been shown and described, it will be obvious to those skilled in the art that various changes and modifications may be made without departing from the spirit and scope of the present invention. For example, the same functions may be achieved by hardwares, and the number of the strings are not limited to six. Each of the threshold values may be given by the player before the playing mode of operation. The number of the rpetitions are not limited to sixteen. The touch data information TOUCH may be provided on the basis of the maximum peak value data information. The limitation values may be shared by all of the fret members if the width of the neck portion is substantially constant. The notes may be assigned to the fret positions by the player, and the signal processing unit 4 may not be built in the guitar like musical instrument. If the tone generator unit 2 is controlled in accordance with MIDI, it is necessary to independently establish the channels including the pitch bends. These establishment may be automatically carried out in the initial stage of the mainroutine program. In the electronic stringed musical instrument described above, the piezo electric transducers 120 to 126 produce the super-sonic vibrations in the strings and receive the super-sonic vibrations reflected from any of the fret members through the strings, respectively, however, another implementation may have two sets of the piezo electric transducers respectively dedicated to the production of the super-sonic vibrations and the receipt of the reflected supersonic vibrations.

What is claimed is:

1. An electronic stringed musical instrument having a parameter adjusting mode and a playing mode of operation, comprising:

(a) a plurality of fret members located at predetermined spacings and respectively assigned to fret positions which in turn are assigned notes, respectively;

(b) a string stretched over said fret members and engageable any of said fret members;

(c) vibration generating and receiving means for producing super-sonic vibrations in said string and receiving the supersonic vibrations reflected from any of said fret members through said string, the super-sonic vibrations transmitted from said vibration generating and receiving means being reflected from a fret member engaged by said string;

(d) fret position deciding means responsive to the supersonic vibrations transmitted from and reflected to said vibration generating and receiving means for deciding the fret position assigned the fret member engaged by said string in said playing mode of operation;

(e) sound production controlling means for producing a sound with the note assigned to the fret position decided by said fret positions deciding means in said playing mode of operation;

(f) mode switching means for selecting one of said parameter adjusting mode and said playing mode; and (g) fret position adjusting means operative to adjust the fret positions for the fret members, respectively, whenever said parameter adjusting mode of operation is selected by using said mode switching means, said fret position adjusting means comprising (g-1) measuring means operative to measure propagation characteristic of said string, (g-2) calculating means operative to decide the fret positions of said fret members on the basis of the propagation characteristic, and (g-3) memory means operative to memorize the fret positions adjusted in said parameter adjusting mode of operation.

2. An electronic stringed musical instrument having a parameter adjusting mode and a playing mode of operation, comprising:

(a) a plurality of fret members located at predetermined spacings and respectively assigned to fret positions which in turn are assigned notes, respectively;

(b) a string stretched over said fret members and engageable any of the fret members;

(c) vibration generating and receiving means for producing super-sonic vibrations in said string and receiving the supersonic vibrations reflected from any of said fret members through said string, the super-sonic vibrations transmitted from said vibration generating and receiving means being reflected from a fret member engaged by said string;

(d) fret position deciding means responsive to the supersonic vibrations transmitted from and reflected to said vibration generating and receiving means for deciding the fret position assigned the fret member engaged by said string in said playing mode of operation;

(e) sound production controlling means for producing a sound with the note assigned to the fret position decided by said fret position deciding means in said playing mode of operation;

(f) mode switching means for selecting one of said parameter adjusting mode and said playing mode; and (g) fret position adjusting means operative to adjust the fret positions for the fret members, respectively, whenever said parameter adjusting mode of operation is selected by using said mode switching means, said fret position adjusting means comprising (g-1) measuring means operative to produce a time interval from a production of said super-sonic vibration to a receipt of said super-sonic vibration reflected from a standard fret member selected from said fret members, the fret position of said standard fret member being produced on the basis of said time interval, (g-2) calculating means operative to decide the fret positions of said fret members on the basis of the fret position measured for said standard fret member, and (g-3) memory means operative to memorize the fret positions adjusted in said parameter adjusting mode of operation.

3. An electronic stringed musical instrument as set forth in claim 2, in which said measuring means measure actual time intervals from the production of said supersonic vibration to the receipt of said super-sonic vibration, and in which said time interval is representative of an average value of said actual time intervals measured by said measuring means.

4. An electronic stringed musical instrument comprising:

(a) a plurality of fret members located at predetermined spacings and respectively assigned to fret positions which in turn are assigned notes, respectively;

(b) a string stretched over said fret members and engageable any of the fret members;

(c) vibration generating and receiving means for producing super-sonic vibrations in said string and receiving the supersonic vibrations reflected from any of said fret members through said string, the super-sonic vibrations transmitted from said vibrations generating and receiving means being reflected from a fret member engaged by said string;

(d) fret position deciding means responsive to the supersonic vibrations transmitted from and reflected to said vibration generating and receiving means for deciding the fret position assigned the fret member engaged by said string;

(e) sound production controlling means for producing a sound with the note assigned to the fret position decided by said fret position deciding means; and (f) a low frequency vibration detecting means operative to detect a low frequency vibration produced by a plucking motion for providing a timing at which the sound is produced, in which said fret position deciding means comprise temporary fret position detecting means for a formation of a temporary fret position, repetition means operative to cause the fret position detecting means to repeat the formation of the temporary fret position a predetermined number of times, and comparator means operative to compare the temporary fret positions with one another and to decide the fret position when the predetermined number of the temporary fret positions are identical with one another.

5. An electronic stringed musical instrument comprising:

(a) a plurality of fret members located at predetermined spacings and respectively assigned to fret positions which in turn are assigned notes, respectively;

(b) a string stretched over said fret members and engageable any of the fret members;

(c) vibration generating and receiving means for producing super-sonic vibrations in said string and receiving the supersonic vibrations reflected from any of said fret members through said string, the super-sonic vibrations transmitted from said vibration generating and receiving means being reflected from a fret member engaged by said string;

(d) fret position deciding means responsive to the supersonic vibrations transmitted from and reflected to said vibration generating and receiving means for deciding the fret position assigned the fret members engaged by said string;

(e) sound production controlling means for producing a sound with the note assigned to the fret position decided by said fret position deciding means;

(f) a low frequency vibration detecting means operative to detect a low frequency vibration produced by a plucking motion for providing a timing at which the sound is produced;

(g) contact detecting means provided under said string and located between said fret members and said vibration generating and receiving means for detecting a contact to said string; and (h) pitch variation prohibiting means for prohibiting the sound from a variation in pitch when said contact is detected by said contact detecting means.

6. An electronic stringed musical instrument as set forth in claim 5, in which said pitch variation prohibiting means are formed by a fret member which no note is assigned.

7. An electronic stringed musical instrument comprising:

(a) a plurality of fret members located at predetermined spacings and respectively assigned to fret positions which in turn are assigned notes, respectively;

(b) a string stretched over said fret members and engageable any of the fret members;

(c) vibration generating and receiving means for producing super-sonic vibrations in said string and receiving the super-sonic vibrations reflected from any of said fret members through said string, the super-sonic vibrations transmitted from said vibration generating and receiving means being reflected from a fret member engaged by said string;

(d) fret position deciding means responsive to the super-sonic vibrations transmitted from and reflected to said vibration generating and receiving means for deciding the fret position assigned the fret member engaged by said string;

(e) sound production controlling means for producing a sound with the note assigned to the fret position decided by said position deciding means; and (f) a low frequency vibration detecting means operative to detect a low frequency vibration produced by a plucking motion for providing a timing at which the sound is produced, in which said low frequency vibration detecting means comprise sampling means operative to detect a series of transient amplitude values of said low frequency vibration, first tendency detecting means operative to detect an increasing tendency in the transient amplitude values for an acknowledgment of the plucking motion, and second tendency detecting means operative to detect a decay tendency in the transient amplitude values after the first increasing tendency for producing the timing.

8. An electronic stringed musical instrument comprising:

(a) a plurality of fret members located at predetermined spacings and respectively assigned to fret positions which in turn are assigned notes, respectively;

(b) a string stretched over said fret members and engageable any of the fret members;

(c) vibration generating and receiving means for producing super-sonic vibrations in said string and receiving the super-sonic vibrations reflected from any of said fret members through said string, the super-sonic vibrations transmitted from said vibration generating and receiving means being reflected from a fret member engaged by said string;

(d) fret position deciding means responsive to the super-sonic vibrations transmitted from and reflected to said vibration generating and receiving means for deciding the fret position assigned the fret member engaged by said string;

(e) sound production controlling means for producing a sound with the note assigned to the fret position decided by said fret position deciding means;

(f) a low frequency vibration detecting means operative to detect a low frequency vibration produced by a plucking motion for providing a timing at which the sound is produced; and (g) bent-string playing technique detecting means for varying the sound in pitch, in which said bent-string playing technique detecting means comprise (g-1) string deviation detecting means for detecting a deviation of said string, (g-2) bent-string playing technique discriminating means for discriminating a bent-string technique detecting means on the basis of said deviation detected by said string deviation detecting means, (g-3) pitch deviation producing means for varying the sound in pitch in response of the deviation produced in said string, and (g-4) prohibiting means operative to estimate a virtual deviation at one of said fret members and to prohibit said pitch deviation producing means from variation in pitch if the virtual deviation exceeds a predetermined value.

9. An electronic stringed musical instrument as set forth in claim 8, in which said prohibiting means further include virtual deviation calculating means operative to calculate the amount of said virtual deviation at said one of said fret members engaged with said string on the basis of the deviation detected by said string deviation detecting means, and judging means operative to decide whether or not the virtual deviation falls within a reasonable range, said judging means prohibiting said variation in pitch if said virtual deviation is out of said reasonable range.

10. An electronic stringed musical instrument comprising:

(a) a plurality of fret members located at predetermined spacings and respectively assigned to fret positions which in turn are assigned notes, respectively;

(b) a string stretched over said fret members and engageable any of the fret members;

(c) vibration generating and receiving means for producing super-sonic vibrations in said string and receiving the super-sonic vibrations reflected from any of said fret members through said string, the super-sonic vibrations transmitted from said vibration generating and receiving means being reflected from a fret member engaged by said string;

(d) fret position deciding means responsive to the super-sonic vibrations transmitted from and reflected to said vibration generating and receiving means for deciding the fret position assigned the fret member engaged by said string;

(e) sound production controlling means for producing a sound with the note assigned to the fret position decided by said fret position deciding means;

(f) a low frequency vibration detecting means operative to detect a low frequency vibration produced by a plucking motion for providing a timing at which the sound is produced; and (g) muting technique detecting means operative to detect a muting technique for rapidly decaying the sound.

11. An electronic stringed musical instrument as set forth in claim 10, in which said muting technique detecting means comprise sampling means operative to produce a series of transient amplitude values, and tendency detecting means operative to detect a large decaying tendency with respect to a decaying tendency due to a lapse of time after the plucking motion for an acknowledgment of the muting technique.

12. An electronic stringed musical instrument comprising:

(a) a plurality of fret members located at predetermined spacings and respectively assigned to fret positions which in turn are assigned notes, respectively;

(b) a string stretched over said fret members and engageable any of the fret members;

(c) vibration generating and receiving means for producing super-sonic vibrations in said string and receiving the super-sonic vibrations reflected from any of said fret members through said string, the super-sonic vibrations transmitted from said vibration generating and receiving means being reflected from a fret member engaged by said string;

(d) fret position deciding means responsive to the super-sonic vibrations transmitted from and reflected to said vibration generating and receiving means for deciding the fret position assigned the fret member engaged by said string;

(e) sound production controlling means for producing a sound with the note assigned to the fret position decided by said fret position deciding means;

(f) a low frequency vibration detecting means operative to detect a low frequency vibration produced by a plucking motion for providing a timing at which the sound is produced; and (g) legato producing means for a smooth variation of the sounds in pitch when the fret position is changed from one to another, in which said legato producing means comprise a legato switch unit for entering an instruction of a legato production, control means operative to direct said sound production control means to produce a sound before a termination of the sound which has been already produced.

13. An electronic stringed musical instrument having a parameter adjusting mode and a playing mode of operation, comprising:

(a) a plurality of fret members located at predetermined spacings and respectively assigned to fret positions which in turn are assigned notes, respectively;

(b) a string stretched over said fret members and engageable any of the fret members;

(c) vibration generating and receiving means for producing super-sonic vibrations in said string and receiving the super-sonic vibrations reflected from any of said fret members through said string, the super-sonic vibrations transmitted from said vibration generating and receiving means being reflected from a fret member engaged by said string;

(d) fret position deciding means responsive to the super-sonic vibrations transmitted from and reflected to said vibration generating and receiving means for deciding the fret position assigned the fret member engaged by said string in said playing mode of operation;

(e) sound production controlling means for producing a sound with the note assigned to the fret position decided by said fret position deciding means in said playing mode of operation;

(f) a low frequency vibration detecting means operative to detect a low frequency vibration produced by a plucking motion for providing a timing at which the sound is produced; and (g) pitch variation prohibiting means provided under said string and located between said fret members and said vibration generating and receiving means, said pitch variation prohibiting means being engageable by said string for prohibiting the sound from a variation in pitch, in which said pitch variation prohibiting means are formed by a fret member for which no note is assigned.

14. An electronic stringed musical instrument having a parameter adjusting mode and a playing mode of operation, comprising:

(a) a plurality of fret members located at predetermined spacings and respectively assigned to fret positions which in turn are assigned notes, respectively;

(b) a string stretched over said fret members and engageable any of the fret members;

(c) vibration generating and receiving means for producing super-sonic vibrations in said string and receiving the super-sonic vibrations reflected from any of said fret members through said string, the super-sonic vibrations transmitted from said vibration generating and receiving means being reflected from a fret member engaged by said string;

(d) fret position deciding means responsive to the super-sonic vibrations transmitted from and reflected to said vibration generating and receiving means for deciding the fret position assigned the fret member engaged by said string in said playing mode of operation;

(e) sound production controlling means for producing a sound with the note assigned to the fret position decided by said fret position deciding means in said playing mode of operation;

(f) a low frequency vibration detecting means operative to detect a low frequency vibration produced by a plucking motion for providing a timing at which the sound is produced; and (g) muting technique detecting means operative to detect a muting technique for rapidly decaying the sound, in which said muting technique detecting means further comprise sampling means operative to produce a series of transient amplitude values, and tendency detecting means operative to detect a large decaying tendency with respect to a decaying tendency due to a lapse of time after the plucking motion for an acknowledgement of the muting technique.

* * * * *